US010253472B2

(12) United States Patent
Garzon et al.

(10) Patent No.: US 10,253,472 B2
(45) Date of Patent: Apr. 9, 2019

(54) METHOD FOR FORMING A STABLE FOUNDATION GROUND

(71) Applicants: Maurice Garzon, Montreal (CA); Lavih Garzon, Pierrefonds (CA)

(72) Inventors: Maurice Garzon, Montreal (CA); Lavih Garzon, Pierrefonds (CA)

( * ) Notice: Subject to any disclaimer, the term of this patent is extended or adjusted under 35 U.S.C. 154(b) by 0 days.

(21) Appl. No.: 15/524,212

(22) PCT Filed: Nov. 16, 2016

(86) PCT No.: PCT/CA2016/051337

§ 371 (c)(1),
(2) Date: May 3, 2017

(87) PCT Pub. No.: WO2017/083969

PCT Pub. Date: May 26, 2017

(65) Prior Publication Data

US 2018/0238012 A1 Aug. 23, 2018

Related U.S. Application Data

(60) Provisional application No. 62/255,658, filed on Nov. 16, 2015.

(51) Int. Cl.

| | |
|---|---|
| ***E02D 3/12*** | (2006.01) |
| ***E02D 3/02*** | (2006.01) |
| ***E02D 3/046*** | (2006.01) |

(52) U.S. Cl.

CPC ..... *E02D 3/123* (2013.01); *E02D 3/02* (2013.01); *E02D 3/046* (2013.01); *E02D 2300/0018* (2013.01); *E02D 2300/0079* (2013.01)

(58) Field of Classification Search

CPC ..... C09K 17/00; B09C 1/00; B09C 1/08

(Continued)

(56) References Cited

U.S. PATENT DOCUMENTS

| | | | | |
|---|---|---|---|---|
| 4,458,763 | A | 7/1984 | Rao | |
| 4,913,586 | A * | 4/1990 | Gabbita | B09C 1/00 210/728 |

(Continued)

FOREIGN PATENT DOCUMENTS

| | | | |
|---|---|---|---|
| DE | 19627465 | A1 | 12/1996 |
| DE | 19612074 | A1 | 10/1997 |
| EP | 0470297 | A1 | 2/1992 |

OTHER PUBLICATIONS

International Search Report for International Patent Application No. PCT/CA2016/051337, dated Feb. 1, 2017 (3 pages).

(Continued)

*Primary Examiner* — Sean D Andrish
(74) *Attorney, Agent, or Firm* — Nixon Peabody LLP

(57) ABSTRACT

A method for transforming existing ground of a given site into a more stable foundation ground is provided. The method includes the steps of defining an outlined area about a surface of the existing ground, excavating soil throughout the outlined area to a depth extending through layers of different soil types; conditioning the excavated soil by mixing together layers of different soil types homogeneously, including in some cases soil imported from an external source; returning the conditioned soil to the outlined area to fill the excavated depth, and compacting the conditioned soil returned to the outlined area, thereby forming the stable foundation ground of high structural capacity and low compressibility.

32 Claims, 12 Drawing Sheets

(58) Field of Classification Search
USPC ..... 405/128.7, 128.75
See application file for complete search history.

(56) References Cited

U.S. PATENT DOCUMENTS

| | | | | |
|---|---|---|---|---|
| 4,940,366 | A | 7/1990 | Suzuki | |
| 5,199,196 | A | 4/1993 | Straley | |
| 5,639,182 | A | 6/1997 | Paris | |
| 5,927,907 | A | 7/1999 | Shiraishi | |
| 6,000,641 | A | 12/1999 | Komoriya | |
| 6,193,444 | B1 | 2/2001 | Jonninen | |
| 6,802,805 | B2 | 10/2004 | Akae | |
| 7,001,105 | B2 * | 2/2006 | Bruso | A01B 79/00 405/128.1 |
| 7,341,405 | B2 | 3/2008 | Gunther | |
| 7,661,907 | B2 * | 2/2010 | Armstrong | E02D 3/026 405/128.6 |
| 2010/0071309 | A1 * | 3/2010 | Brangan | C09K 17/18 52/741.15 |
| 2012/0207551 | A1 * | 8/2012 | Guilbault | C09K 17/36 405/263 |
| 2015/0273544 | A1 * | 10/2015 | Gallagher | B09C 1/00 405/128.55 |

OTHER PUBLICATIONS

Written Opinion of the International Searching Authority for International Patent Application No. PCT/CA2016/051337, dated Feb. 1, 2017 (3 pages).

* cited by examiner

| SITE CLASS | SOIL PROFILE NAME | SHEAR WAVE VELOCITY ft/s (m/s) | STANDARD PENETRATION TEST (blows/foot) | UNDRAINED SHEAR STRENGTH pdf (kPa) |
|---|---|---|---|---|
| A | Hard rock | > 5000 (> 1500) | | |
| B | Rock | 2500 to 5000 (760 to 1500) | | |
| C | Very dense soil and soft rock | 1200 to 2500 (360 to 760) | >50 | > 2000 (>100) |
| D | Stiff soil profile | 600 to 1200 (180 to 360) | 15 to 50 | 1000 to 2000 (50 to 100) |
| E | Soft soil profile | <600 (<180) | <15 | < 1000 (<50) |
| F | Soils requiring site specific evaluation | | | |

FIG. 1

METHOD FOR FORMING A STABLE FOUNDATION GROUND

CROSS REFERENCE TO RELATED APPLICATIONS

This application is a National Stage of International Application No. PCT/CA2016/051337, filed Nov. 16, 2016, which claims the benefit of and priority to U.S. provisional patent application No. 62/255,658, filed Nov. 16, 2015, each of which is hereby incorporated by reference herein in its entirety.

TECHNICAL FIELD

The technical field generally relates to soil transformation. More particularly, it relates to methods for transforming existing ground of a given site into a more stable foundation ground, and to foundation structures formed thereon.

BACKGROUND

Stabilization against liquefaction, for high bearing capacity, and reduced compressibility of foundation soil at depth are essential requirements to insure the stability of engineered structures built thereon. It is also essential to insure that no internal erosion under existing hydraulic seepage gradients and through permeable channels within the soil mass could lead to settlements and even to the development of sinkholes. These requirements are particularly important for large and/or sensitive structures such as bridges, dams, high-rise buildings and retaining structures, among others. It is also a major concern for slopes and stockpiles in general, and in particular when roads and railroads are built and used near them. It is a further concern for retaining structures of contaminated soils and mine tailings.

The properties of the foundation soil will have an important impact on the foundation's bearing capacity and its ability to withstand liquefaction. A vast area of the earth's surface is covered by loose sedimentary soil deposits which include thick strata of poorly graded soils that are prone to liquefaction during earthquakes, and which remain unstable even after deep densification. Generally, these soils do not yield an allowable bearing capacity above 150 kPa after densification and remain sensitive to liquefaction during earthquakes. As such, depending on a given location, the natural soil may not be suitable for supporting certain types of large and/or sensitive structures.

Several techniques exist to improve soil conditions so that the soil is more suitable for supporting structures. These techniques involve densifying the soil by using specialized tools and/or reinforcing the soil by embedding specialized structures therein. While these techniques have proven useful for some applications, there is much room for improvement.

Dynamic compaction increases soil density through repeated high energy impacts. This technique involves repeatedly dropping a heavy weight onto the ground at regular intervals. The force of impact of the weight causes the ground to compact and thus increase its bearing capacity. This technique is most effective for well-graded soil, and when densification at depths greater than 10 m is not required. Disadvantageously, the high energy impacts can cause undesirable effects to nearby structures, such as railroad tracks or buildings for example, due to vibration. Further, the existence at depth of undesirable soils or materials impact greatly on the efficiency of direct dynamic compaction. This is particularly true in case of sensitive clay formation or presence in the soil volume.

Vibroflotation, also referred to as vibro compaction, is another soil densification technique which increases soil density through vibration. This technique involves vibrating a cylindrically-shaped vibroflot or plunger in the ground, encouraging soil particles to rearrange in a more compact fashion. The vibration of the vibroflot induces an acceleration and vibration of the soil particles, allowing the vibroflot to be lowered into the ground. Once the soil is sufficiently compacted, the vibroflot is raised out of the ground. As with dynamic compaction, this technique works best on well-graded soil. Disadvantageously, this technique can be quite expensive, and is not effective when the soil is uniformly graded. Moreover, this technique leaves significant volumes of non-stabilized soils between the treated soil in the ground and cannot be performed where adjacent structures are close by.

Stone columns, also referred to as vibro replacement, is a technique for reinforcing and densifying soil. This technique involves creating a grid or lattice of stone columns underground by forcing stones of varying sizes into the soil. The columns act as reinforcements, providing discrete areas of increased rigidity in the soil which have an increased bearing capacity. Soil is also densified using this technique, as the action of forcing the stones into the soil causes soil surrounding the columns to be compacted. Disadvantageously, this technique is significantly more expensive relative to other techniques such as dynamic compaction. Also, this technique may cause the resulting soil to have inconsistent strength: uniform soil in the space between columns is weaker than the soil in and surrounding the columns. Uniform soil between columns is not transformed and may therefore still have undesirable properties. As a result, soil reinforced by this technique may not be well suited for withstanding earthquakes. During an earthquake, the uniform soil between columns can liquefy and displace, thus causing the columns to deform and/or break. Further undesirable mixing of the natural soils with the gravel of the stone columns often occurs and reduces the vertical permeability of the stone column and impairs its efficiency as a potential relief column for the pore pressures generated at depth, under a seismic event. The stone columns may also not always succeed to reach the bottom of the liquefiable layer which in the past has led to major damage during earthquake. Another concern occurs when the liquefied layer lies over a sensitive and or weak clay formation: the base of the stone columns would in this case rest on the weak layer. The load transfer from the stone column during an earthquake could become excessive should the confinement of the walls of the stone column become affected by the moving or by the settlement of liquefiable soils still present between the stone columns.

The cemented columns technique is a technique for reinforcing soil by creating a grid or lattice of cement-based columns underground. The technique involves drilling holes in the ground and filling the holes with a cement-based material. This technique is even more expensive than the stone columns technique. As with stone columns, the cemented columns technique may cause the resulting soil to have inconsistent strength: uniform soil between columns is not transformed, and may still have undesirable properties, making it susceptible to liquefaction. Cemented columns may therefore also not be well suited for withstanding earthquakes.

Another technique, known as engineered soils, involves replacing the natural soil entirely. If the natural soil has undesirable properties, for example if it cannot be sufficiently compacted, the soil can be excavated and replaced with a more suitable better graded soil. While this technique allows for a homogeneous strength of the resulting soil, it can be quite expensive and labor intensive as a large amount of soil will have to be transported to and from remote locations. Also, conventional compaction of saturated engineered fill may be problematic to achieve the desired degree of compaction by means of conventional compaction equipment.

Also known to the Applicant are the following publications: U.S. Pat. Nos. 6,802,805; 6,193,444; 6,000,641; 5,927,907; 5,199,196; 4,458,763; DE 19627465; DE 19612074; and EP 470297.

Despite these know techniques, there is a need for a method of soil treatment or transformation which, by virtue of its steps, design and/or components, would be able to overcome or at least minimize some of the aforementioned prior art problems.

SUMMARY

According to an aspect, a method is provided for transforming natural soil into a conditioned soil, the natural soil comprising a plurality of layers. The method includes the steps of delimiting an excavation area, excavating the natural soil, treating the excavated soil to obtain a conditioned soil, and returning the conditioned soil to the excavation area, wherein treating the excavated soil comprises mixing at least some of the excavated natural soil layers to obtain a homogeneous mixture of soil, the conditioned soil comprising the homogeneous mixture of soil.

In an embodiment, the method includes the step of determining a combination of the natural soil layers required to obtain a mixture of soil which is well-graded, and delimiting a depth of the excavation area so as to excavate the required natural soil layers.

In an embodiment, the depth of the excavation area is delimited so as to excavate the natural soil down to stable ground.

In an embodiment, the well-graded mixture of soil comprises particles with varying sizes, the particles of the well-graded mixture of soil together representing a wide range of particle sizes with a good distribution of sizes between 0.001 mm and 150 mm or more.

In an embodiment, the combination of natural soil layers comprises at least one layer which is poorly graded. In am embodiment, the combination of the natural soil layers comprises up to about 20% of clay size particles of low sensitivity.

In an embodiment, the at least one poorly graded soil comprises particles which together represent a narrow range of particle sizes, or do not have a good distribution of sizes of particles between 0.001 mm and 150 mm or more, or do not have a good representation of particles sizes in a reasonable portion of the particle size range spectrum.

In an embodiment, treating the excavated soil includes the step of removing undesirable materials from the excavated soil, the undesirable materials corresponding to materials which are susceptible to compromise the long term or short term stability of the conditioned soil.

In an embodiment, the undesirable materials comprise non-compactable material, compressible, or unstable material such as degradable or collapsible soil.

In an embodiment, the treating the excavated soil includes the step of introducing additives into the mixture of soil.

In an embodiment, the additives introduced into the mixture comprise material with particle sizes which, when introduced into the mixture of soil, provide the mixture of soil with a wide range particle sizes with a good distribution of sizes between 0.001 mm and 150 mm or more.

In an embodiment, the additives introduced into the mixture comprise a cementing agent.

In an embodiment, the additives introduced into the mixture comprise a filler.

In an embodiment, the method includes the step of reinforcing the conditioned soil.

In an embodiment, reinforcing the conditioned soil comprises providing superposed geogrids, metal strips or geotextile sheets in the conditioned soil to reduce lateral stress transfer from foundation loading.

In an embodiment, the method includes the step of compacting the conditioned soil once it is returned to the excavation area.

In an embodiment, compacting the conditioned soil comprises kneading the soil with vibratory plates.

In an embodiment, the conditioned soil is returned to the excavation area in 0.5 m to 20 m layers at a time, with each layer of conditioned soil being compacted before returning a subsequent layer of conditioned soil to the excavation area.

In an embodiment, the method further includes the step of building a foundation structure in the conditioned soil.

In an embodiment, the method is performed prior to building a sensitive structure such as a dam or a bridge, thereby providing said structure with a stable foundation in which dangerous risks such as large settlement from collapsible soil or such as sinkholes are eliminated. Elimination of hydraulic erosive permeable channels in the existing stratigraphy, that would still be maintained after the application of other known methods of soil densification known in the art, can be eliminated by way of applying the present method.

In an embodiment, the method further includes the step of building cementitious retaining walls in the conditioned soil to retain structures under earthquake dynamic loading.

In an embodiment, building the cementitious retaining walls comprises defining an outline of a wall to be formed, the outline delimitating an area of soil to be excavated; compacting the area of soil to be excavated; excavating the soil from the area compacted to an initial depth, thereby creating a wall cavity, the wall cavity comprising a bottom surface and side surfaces; compacting the bottom surface of the wall cavity and subsequently excavating the soil from the compacted bottom surface; repeating the previous steps until a final depth of the wall cavity is reached and filling at least part of the wall cavity with a cementitious material so as to form a retaining wall. In an embodiment, compaction steps at different depths of excavation for the retaining wall are not necessary where the soil mass receiving the wall has been previously conditioned and densified as per the method of the present invention.

In an embodiment, the method further includes the step of building stable piles and/or anchor systems in the conditioned soil to retain structures under earthquake dynamic loading.

According to an aspect, conditioned foundation soil is provided, the conditioned foundation soil being created using the method described above.

According to an aspect, a foundation is provided, the foundation including a mass of conditioned soil formed as described above, and cementitious structures embedded in the mass of conditioned soil.

In an embodiment, the cementitious structures comprise buried cementitious retaining walls positioned around a perimeter of a building imprint and being secured thereto to prevent a lateral or rotational movement of the building foundations or of the soil structure confined between adjacent walls.

In an embodiment, the cementitious structures are secured to the building via a retaining structure.

In an embodiment, the cementitious structures are secured with piles, the piles securing the cementitious structures to a stable soil layer.

According to an aspect, a method is provided for reducing a foundation footing width in direct contact with conditioned soil. The method includes the steps of conditioning the soil as described above and separating portions of a foundation footing from contact with the soil by placing highly compressible materials under intermediate strips of a wider mass or foundation thus reducing the depth of load transfer and mobilizing the available high bearing capacity and low compressibility of the stabilized conditioned soil mass.

In an embodiment, the foundation footing is provided with styrofoam blocks, thereby segmenting the foundation footing into sections.

According to an aspect, a foundation footing is provided, the foundation footing comprising a body defining a ground-contacting area, the ground contacting area being provided with a spacing mechanism for spacing at least a portion of the ground-contacting area from the ground.

According to an aspect, a kit is provided for forming a foundation, the kit including tools to transform the soil according to the method described above.

In an embodiment, the kit is provided with tools for forming any of the foundation structures described above.

According to an aspect, a method of transforming existing ground of a given site having soil with a plurality of different sections with different soil properties, into a supporting foundation ground is provided. The method includes the steps of: a) defining an outlined area about a surface of the given site, the outlined area corresponding to a work area of the existing ground to be transformed; b) excavating the soil throughout the outlined area to a level extending beyond the plurality of different sections with different soil properties, thereby creating a cavity comprising a bottom surface and a side surface within the ground to be transformed; c) conditioning the soil excavated in step b) by mixing together at least two different sections with different soil properties, thereby forming a conditioned soil including a homogeneous mixture of said at least two different sections with resulting uniformized soil properties; d) returning the conditioned soil, via the outlined area, into the cavity excavated in step b), to homogeneously fill said cavity; and e) compacting the conditioned soil returned to the cavity, via the outlined area, thereby forming the supporting foundation ground.

According to an aspect, a method of transforming existing ground of a given site having soil with a single or a plurality of layers of different soil types into a more stable foundation ground is provided. The method includes the steps of: a) defining an outlined area about a surface of the existing ground, the outlined area corresponding to an area of the existing ground to be transformed; b) excavating the soil throughout the outlined area to a depth extending through the single or the plurality of layers of different soil types; c) conditioning the soil excavated in step b) by mixing together at least one or two of the layers of different soil types, thereby forming conditioned soil including a homogeneous mixture of the at least one or two layers of different soil types; d) returning the conditioned soil to the outlined area to homogeneously fill the depth excavated in step b) throughout the outlined area; and e) compacting the conditioned soil returned to the outlined area, thereby forming the stable foundation ground.

In an embodiment, step e) includes applying a vibratory force to the conditioned soil.

In an embodiment, step e) includes kneading the conditioned soil using a vibratory plate.

In an embodiment, step e) includes the step of performing dynamic compaction, vibroflotation, stone columns, and/or cemented columns to achieve densification of the returned soil.

In an embodiment, steps d) and e) include returning the conditioned soil to the outlined area in successive layers, and individually compacting each successive layer prior to returning a subsequent layer of conditioned soil.

In an embodiment, step d) includes returning the conditioned soil to the outlined area in successive layers having a depth between about 0.5 m and about 20 m, and preferably between about 1.5 m and about 3 m.

In an embodiment, step b) includes excavating the soil in the outlined area to a depth extending down to natural bedrock or to stable lower soil such as a dense till.

In an embodiment, in step b), the soil in the outlined area is excavated to a depth of at least 2 m and preferably to a depth of at least 20 m.

In an embodiment, in step c), conditioning the soil excavated in step b) includes adjusting a composition of the homogeneous soil mixture such that the homogeneous soil mixture is substantially well-graded.

In an embodiment, the composition of the homogenous soil mixture is adjusted to include a representation of particle sizes distributed in a range between about 0.001 mm and about 150 mm or more.

In an embodiment, the composition of the homogenous soil mixture is adjusted to include a representation of particle sizes distributed in a range from No. 4 to No. 200 sieves.

In an embodiment, the composition of the homogeneous soil mixture is adjusted to include a uniformity coefficient $C_u$ greater than about 4 and a coefficient of curvature $C_c$ between about 1 and about 3, where $$C_U = \frac{D_{60}}{D_{10}} \text{ and } C_C = \frac{D_{30}^2}{D_{10} \cdot D_{60}}$$

and where $D_{60}$ is a grain diameter of the homogenous soil mixture at 60% passing, and $D_{10}$ is a grain diameter of the homogenous mixture at 10% passing.

In an embodiment, adjusting the composition of the homogeneous soil mixture includes excluding from the homogeneous soil mixture at least part of at least one of the layers of different soil types excavated in step b).

In an embodiment, adjusting the composition of the homogeneous soil mixture includes completely excluding from the homogeneous soil mixture at least one of the layers of different soil types excavated in step b).

In an embodiment, adjusting the composition of the homogeneous soil mixture includes excluding from the homogeneous soil mixture at least one of the layers of different soil types including at least one of: organic material, non-compactable material, soft clay, clay silt and material with a shear strength of less than about 15 kPa.

In an embodiment, adjusting the composition of the homogeneous soil mixture includes selecting a mixing ratio for each of the layers of different soil types excavated in step b) required to obtain a well-graded soil mixture, and mixing the layers of different soil types together according to the selected ratio.

In an embodiment, adjusting the composition of the homogenous soil mixture includes identifying at least one of the layers of different soil types as being poorly graded by having an excess or deficiency of at least one particle size, and mixing the at least one identified layer with at least one other of the layers of different soil types to correct for the excess or deficiency of the at least one particle size.

In an embodiment, adjusting the composition of the homogeneous soil mixture includes mixing additives together with the at least one or two of the layers of different soil types.

In an embodiment, adjusting the composition of the homogeneous soil mixture includes identifying a deficiency of at least one particle size in the homogenous soil mixture, and mixing an additive including the at least one particle size together with the homogenous soil mixture to correct for the deficiency.

In an embodiment, mixing additives together with the at least one or two of the layers of different soil types includes mixing-in an additive including imported soil from a foreign site.

In an embodiment, mixing additives together with the at least one or two of the layers of different soil types includes mixing-in an additive including a filler including well-graded soil.

In an embodiment, mixing additives together with the at least one or two of the layers of different soil types includes mixing-in a cementing agent.

In an embodiment, the method further includes individually analyzing a composition of the layers of different soil types as they are excavated, and determining an amount of the analyzed soil layer to include or exclude from the homogeneous mixture to make the conditioned soil well-graded.

In an embodiment, the method further includes individually analyzing a composition of the layers of different soil types as they are excavated, and determining additives to include in the homogeneous mixture to make the conditioned soil well-graded.

In an embodiment, step b) includes completely excavating to the depth throughout the outlined area before proceeding to return the conditioned soil in step d).

In an embodiment, step b) includes excavating to the depth in a partial area of the outlined area, and returning the conditioned soil to the partial area in step d) before repeating step b) for another partial area of the outlined area.

In an embodiment, steps b) and c) include excavating and mixing adjacent layers of different soil types to form an intermediate mixture, before excavating subsequent layers and adding them to the intermediate mixture, and repeating until all the soil layers have been excavated to the depth.

In an embodiment, step b) includes extracting the excavated soil from the outlined area.

In an embodiment, step b) includes displacing the excavated soil away from the outlined area.

According to an aspect a method for forming a stable foundation ground is provided. The method includes mixing together a plurality of layers of different soil types existing on a site, homogeneously throughout an area and a depth of the site to obtain a well-graded soil mixture, and compacting the well-graded soil mixture by applying a vibratory force.

According to an aspect a stable foundation ground is provided, the stable foundation ground being formed according to a method as defined above.

The objects, advantages and other features of the present system will become more apparent upon reading of the following non-restrictive description of optional configurations thereof, given for the purpose of exemplification only, with reference to the accompanying drawings.

BRIEF DESCRIPTION OF THE DRAWINGS

FIG. 1 is a table illustrating site classifications according to soil properties.

DETAILED DESCRIPTION

Figure 2A:
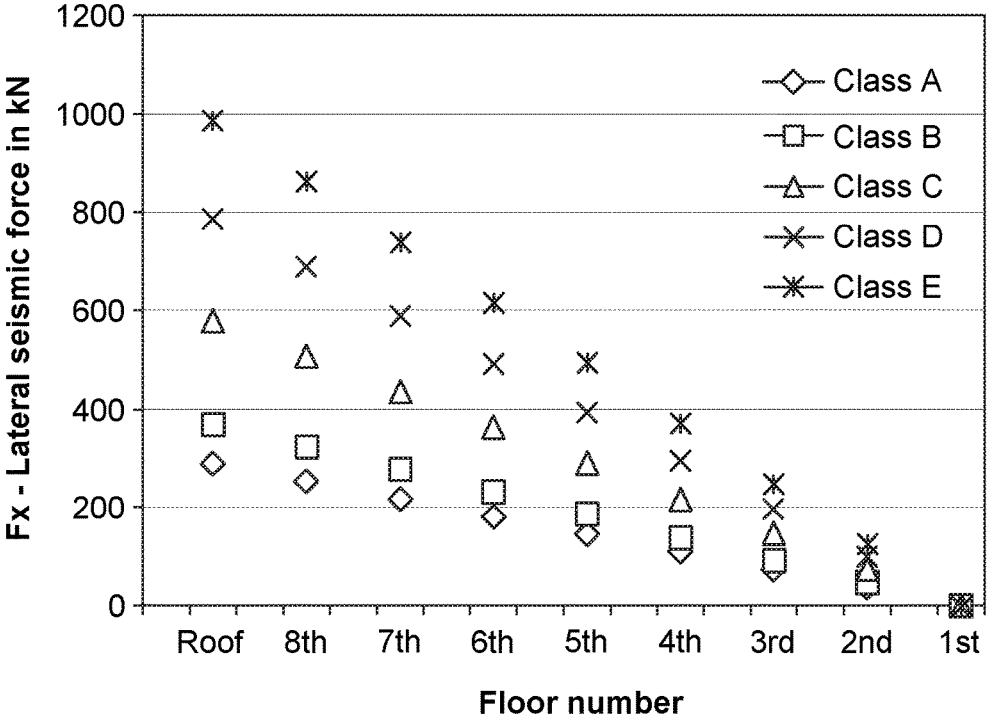
FIGS. 2A and 2B are graphs respectively illustrating the magnitude of lateral seismic force and seismic overturning moment expected for a multi-storey building during an earthquake according to the site classifications of FIG. 1 and specific earthquake magnitude and ground acceleration.

In the following description, the same numerical references refer to similar elements. Furthermore, for sake of simplicity and clarity, namely so as to not unduly burden the figures with several references numbers, not all figures contain references to all the components and features of the present invention and references to some components and features may be found in only one figure, and components and features of the present invention illustrated in other figures can be easily inferred therefrom. The embodiments, geometrical configurations, materials mentioned and/or dimensions shown in the figures are preferred, for exemplification purposes only.

Moreover, although the method may be used for the "transformation of soil", for example, it may be used with objects and/or bodies made from other flowable materials. For this reason, the use of expressions such as "transformation", "conditioning", "densifying", "soil", "ground", "earth", etc., as used herein should not be taken as to limit the scope of the method to these specific materials and includes all other kinds of materials, objects and/or purposes with which the method could be used and may be useful.

Moreover, in the context of the present description, the expressions "method", "system", "process", "product", "equipment", "assembly", "tool", "method" and "kit", as well as any other equivalent expressions and/or compounds word thereof known in the art will be used interchangeably, as apparent to a person skilled in the art. This applies also for any other mutually equivalent expressions, such as, for example: a) "transforming", "conditioning", "uniformizing", "mixing", "densifying", etc.; b) "layer(s)", "segment(s)", "area(s)", "location(s)", "section(s)", etc.; c) "soil", "ground", "earth", "material", etc.; d) "type", "property", "feature", "characteristic", etc.; as well as for any other mutually equivalent expressions, pertaining to the aforementioned expressions and/or to any other structural and/or functional aspects of the present invention, as also apparent to a person skilled in the art.

Moreover, components of the present system(s) and/or steps of the method(s) described herein could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiment of the present invention as illustrated in the accompanying drawings comprises various components and although the preferred embodiment of the transformed ground and/or foundation structures as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations therein between, as well as other suitable geometrical configurations may be used for the transformed ground and/or foundation structures and corresponding parts, according to the present invention, as briefly explained and as can be easily inferred herefrom by a person skilled in the art, without departing from the scope of the invention.

Broadly described, the method of the present disclosure involves transforming existing ground of a given site to form a more stable foundation ground. The transformation involves conditioning soil on the site by combining layers of different soil types on the site into a homogeneous mixture, the resulting homogeneous mixture preferably being well-graded to very well-graded and suitable for supporting large and/or sensitive structures.

The properties of the ground or soil at a given site can be used to classify the site according to one of several classes for seismic forces calculations. With reference to the table of FIG. 1, the site class can be determined according to the average engineering properties of the soil to a depth of approximately 30 m. As shown in the table of FIG. 1, the site class can range between Class A and Class F according to the 2006 International Building Code, with Class A corresponding to the strongest soil conditions, such as hard rock (with shear wave velocity exceeding 1500 m/s), and Class F corresponding to the weakest soil conditions, such as soft clay.

As can be appreciated, weaker soil conditions are less desirable as they require structures with more robust stabilization designs. Where the soil conditions are poor, very large forces and moments must be accounted for in the design of the structure. The higher the structure, the more intense translational forces and moments of rotation are generated on the structure.

Figure 2B:
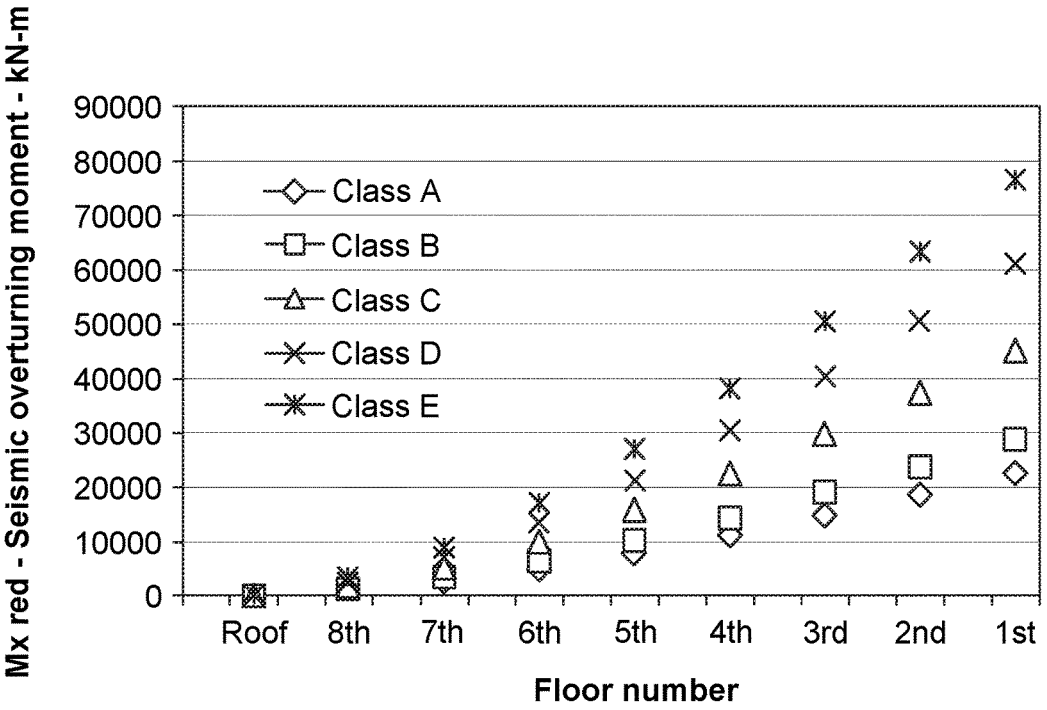

With reference to the graphs in FIGS. 2A and 2B, an 8 storey building on a Class A site experiences significantly less lateral seismic force and seismic overturning moment than a corresponding building on a Class E site. As a result, in weaker soil conditions, major reinforcements and large stabilization masses of great dimensions are sometimes required to prevent the uncontrolled displacement of the structure and structure collapse during an earthquake. Class A or Class B sites are generally ideal in the case of large and/or sensitive structures, in order to reduce the structural requirements and in order to meet safety standards. However, Class C and Class D sites are generally sufficient to meet safety requirements, with reasonable structural reinforcement and confinement without requiring extensive structural requirements.

Figure 3A:
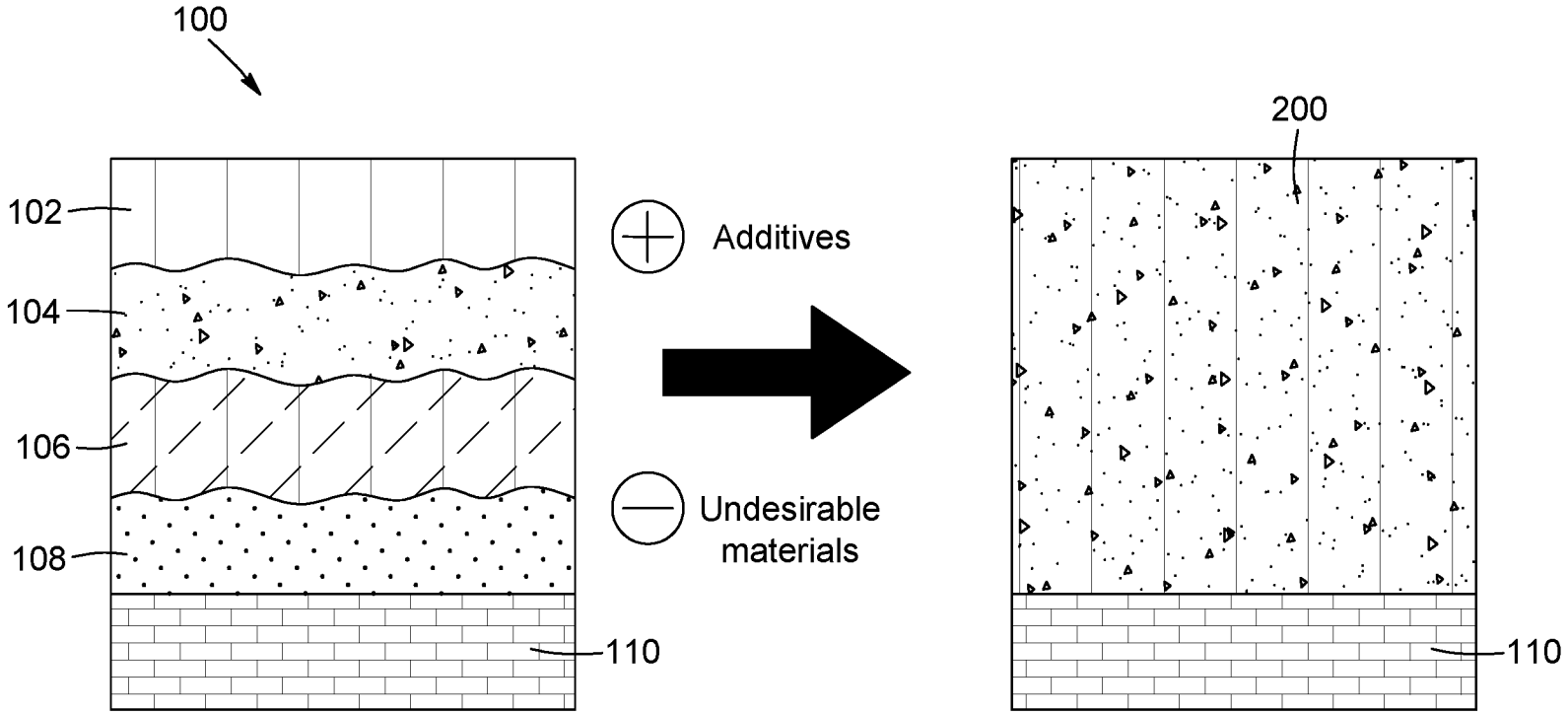
FIG. 3A is a schematic illustrating natural soil layers, and their transformation into a well-graded conditioned soil mixture.

Due to geological variations, a given site can have ground with many different types of soil. As schematically illustrated in FIG. 3A, natural or existing ground 100 can consist of one or several different soil types. For the purposes of the present disclosure, natural or existing ground 100 can refer to ground which exists naturally on a site prior to human intervention, or ground which was formed by natural geological processes. It may also refer to ground on a site that is not homogeneous at depth, and which exists on the site prior to transformation by the processes described herein. The different soil types in the existing ground 100 can include one or a plurality of different materials, including peat (not illustrated), uniform silt 102, well-graded medium sand 104, gravel (not illustrated), uniform coarse sand 108 and/or silty soft clay 106, among others, before reaching dense glacial till or bedrock 110. The different materials each have their own properties which determine their susceptibility to liquefaction, their bearing capacity, their compressibility, their permeability and their stability. The different soil types can be distributed in the natural ground 100 in a variety of different manners. For illustrative purposes, the different soil types are shown as being distributed throughout the depth of the natural ground 100 as superposed layers. However, it is appreciated that when referring to different "layers" of different soil types, this can include any distribution of different soil types which is not homogeneous. For example, layers of different soil types can refer to superposed rectilinear layers, but can also include other distributions of different soil types, such as pockets or communication flow channels.

Each of these layers of different soil types can be poorly graded or well-graded. Poorly graded materials (i.e. materials which do not have good distribution or representation of particle sizes, generally between about 0.001 mm and about 150 mm or more) such as uniformly graded materials (i.e. materials comprising same-sized particles), or gap-graded materials (i.e. materials lacking a certain size of particle or having a surplus of a certain size of particle), are generally weaker and more susceptible to liquefaction. Well-graded materials (i.e. materials comprising particles of many different sizes, and which have a good representation of particles sizes, generally between about 0.001 mm and about 150 mm or more) are generally stronger, less susceptible to liquefaction, less susceptible to compression, less susceptible to internal erosion and thus more desirable for a stable foundation.

The grading of a soil can be measured using a sieve analysis, for example, which involves passing the soil through a series of standard-sized sieves (for example through various sieves between a No. 4 sieve at 4.76 mm and a No. 200 sieve at 0.074 mm) in order to measure the quantity of different particle sizes in the soil. By some standards, soil can be classified as well graded if it contains particles of a wide range of sizes and has a good representation of all sizes from the No. 4 to the No. 200 sieves.

Figure 3B:
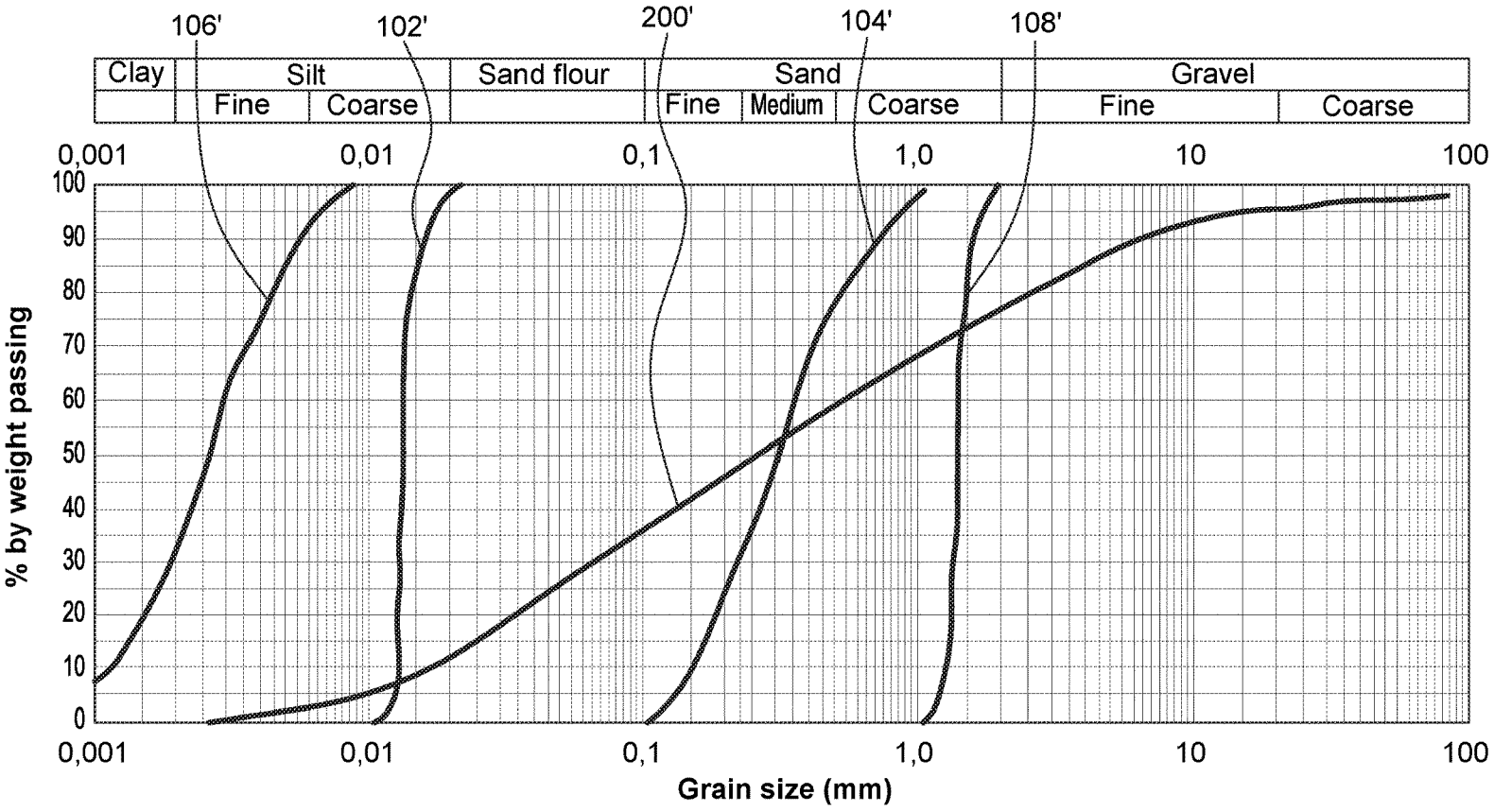
FIG. 3B is a graph schematically showing sieve analysis of the natural soil layers and the well-graded conditioned soil mixture.

The results from a sieve analysis can be plotted on a graph of cumulative percent weight passing versus the logarithmic sieve size, as shown in FIG. 3B. Such graphs can give a good visual indication of the type of grading of soil. Uniform or poorly graded soils (such as curves for uniform silt 102' and uniform coarse sand 108') will have a steep slope and a nearly vertical drop on the graph, indicating that they are made up of particles of one size. Well-graded soils (such as curved for well-graded medium sand 104' and silty soft clay 106') will have a less steep or smoother slope which drops off more gradually, indicating that the soil is made up of many particle sizes. Very well-graded soils (such as curve for the conditioned soil 200') will have a slight incline, preferably extending along the width of the graph, indicating that not only is it made up of many particle sizes, but it also made up of a wide spectrum of particle sizes (i.e. from 0.001 mm to 150 mm in diameter or more).

From a quantative perspective, well-graded soil can generally be defined as soil with a uniformity coefficient $C_u$ greater than about 4 to about 6 and more, and with a coefficient of curvature $C_c$ between about 1 and about 3, where:

$$C_U = \frac{D_{60}}{D_{10}} \text{ and } C_C = \frac{D_{30}^2}{D_{10} \cdot D_{60}}$$

with $D_X$ corresponding to the particle diameter at X % passing. For example, fine sand can be classified as well graded if it has a $C_u \geq 6$, whereas gravel can be classified as well graded if it has a $C_u > 4$.

An object of the method described herein is to transform the ground at a given site so that its soil is homogeneous, i.e. is not composed of distinct layers of different materials at depth above original stable lower soil formations, and so that the ground has properties preferably resembling those of at least a Class C or Class D site and is thus suitable for stably supporting large and/or sensitive structures. Preferably, the resulting soil is well-graded to very-well graded and does not contain unstable layers.

As schematically illustrated in FIG. 3A, distinct layers of materials such as 102, 104, 106 and 108 can be conditioned, for example by mixing the layers, by combining the layers, by introducing additives and/or by removing undesirable materials, in order to form a well-graded mixture of conditioned soil 200 which is preferably homogeneous. The individual materials used in the mixture can contain only poorly graded materials, such as silt 102, or uniform coarse sand 108, only well-graded materials such as medium sand 104, or silty soft clay 106, or a combination of both. The mixture can contain one type of soil material, or a plurality of different materials. By mixing one or more of the materials, a well-graded to very well-graded homogeneous conditioned soil 200 can be obtained, which can be used to form a superior and more stable foundation ground than the non-homogenous layers and/or more stable than any of the natural layers individually.

As one skilled in the art understands, poorly graded materials such as silt 102 and uniform coarse sand 108 are not suitable for stabilization after compaction. In contrast, conditioned soil 200 is well-graded and is thus more suitable for stabilization after compaction, as the particles can be rearranged so that smaller particles fill the gaps between larger particles, thereby reducing voids and increasing the interlocking between particles of different sizes.

As can be appreciated, mixing different layers of soil can allow for a final mixture which has a good representation of all particle sizes, and is thus well-graded, suitable for compaction, and more suitable for stably supporting large and/or sensitive structures. Preferably, soil mixture 200 is mixed such that it is a homogeneous material whose composition comprises particles from at least some of the distinct layers 102, 104, 106, 108, for example from at least one or two of the layers of different soil types. However, other additives may be introduced into the soil mixture in order to further improve its properties. For example, if it is determined that a mixture of the natural layers would have a deficiency of a certain particle size that would be required to make the mixture well-graded, particles having that size can be added to the mixture. Likewise, if it is determined that there is a surplus of a certain particle size, material with that particle size, or a portion thereof, can be excluded from the mixture. Moreover, some layers can be removed if they are unstable or not suitable for compaction, such as silty soft clay 106, even if they are well-graded, or if they are susceptible to degradation (such as peat). Finally, after mixing and conditioning the soil, the conditioned soil mixture 200 can be compacted so that it will have an increased bearing capacity and will be resistant to liquefaction. As will be appreciated, the described method has numerous advantages, allowing the process to be tightly controlled to assure homogeneity.

As can be further appreciated, conditioning natural soil such that the resulting foundation soil is homogeneous at depth can allow for the full composition of the foundation soil to be known, and allows for geological hazards to be removed, thereby resulting in a more stable foundation soil mass. For example, major variations of ground conditions from natural or artificial deposits could lead to catastrophic ground behavior causing the collapse of dams, bridges, and other buildings. As illustrated schematically in FIG. 3C, ground 100 with untransformed soil can include a high permeability layer 118, such as coarse gravel, buried under a formation of fine uniform sand 119. A flow of water 116, 117 of significant velocity and energy, such as a buried yet active river bed, can travel through the permeable layer 118. Since the gradation differences between the top uniform sand 119 and the lower gravel 118 layer are large, there is no filtering effect offered by the gravel 118 and the fine sand 119 is siphoned into the gravel layer 118 and carried away generating voids 114 in the sand formation 119 with an accelerating destabilization and loss of materials. This can cause the eventual development of sinkholes reaching initially the original ground surface on which the lower part of a structure is built, or the dike built over it, before spreading into the dike and leading to major settlement and cracking and to their failures. Once the soil in ground 100 is transformed into a well-graded densified mass of conditioned soil 200 to depth D, the soil mass is impermeable in principle. The water flow 116 is thus blocked 121 from passing through the conditioned soil 200, avoiding the future development of sinkholes, and eliminating the risks of sinkhole development which can be particularly aggravated by rising upstream water, for example for dam structures or the like. Any existing voids 114 in the untransformed soil are also removed through the soil transformation process, and the resulting conditioned soil 200 is a substantially uniform stable mass.

Figure 3C:
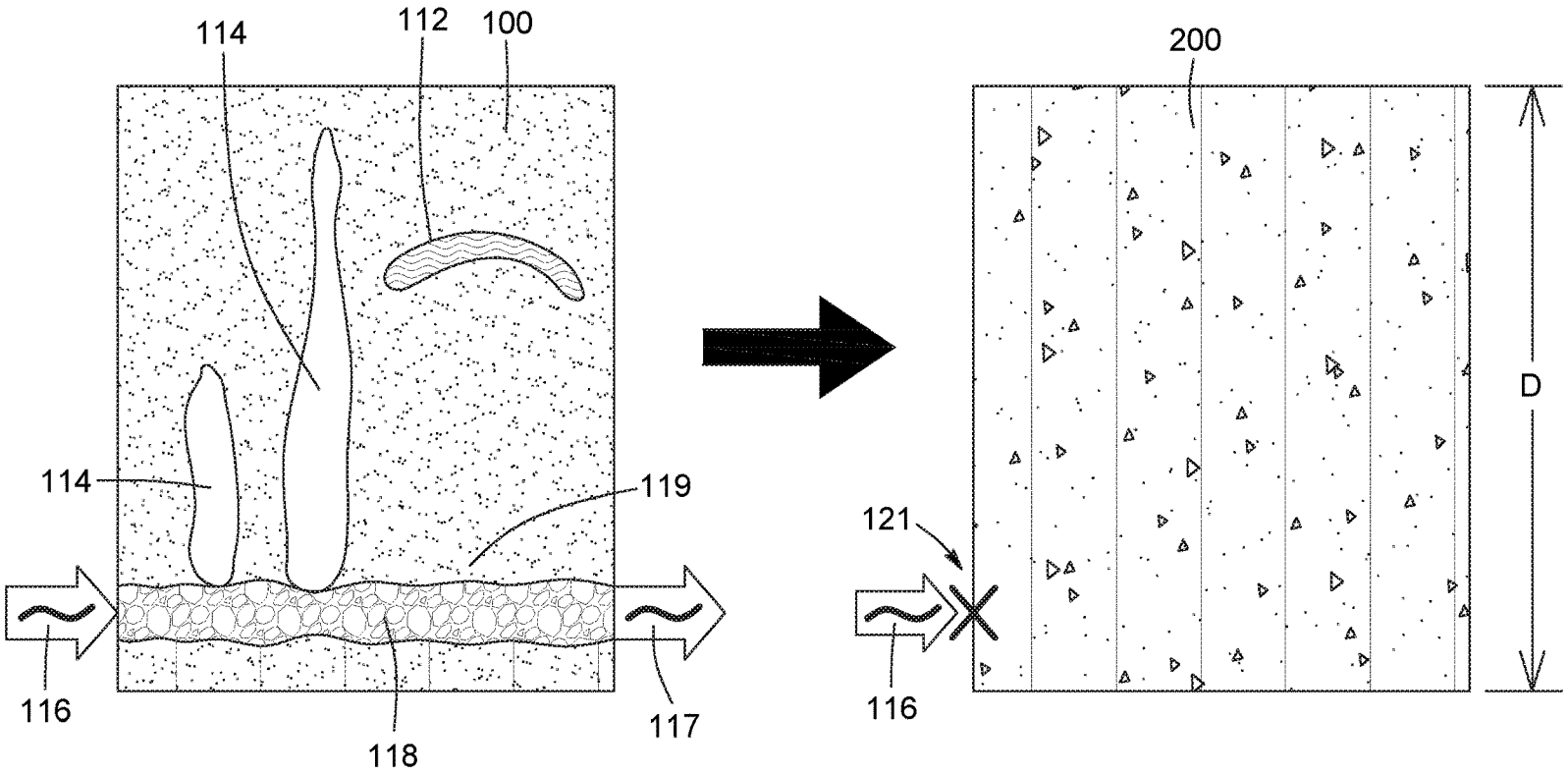
FIG. 3C is a schematic illustrating a natural site with a variable stratigraphy having internal erosion, and its transformation into a stable soil mass according to an embodiment.

FIG. 3C also illustrates the presence of compressible and decaying organics 112 buried in the original soil mass not always possible to identify in geotechnical investigations (for example in the form of a pocket). Unless these organics are found early enough during the project development, they will generate settlements that may cause major harms to the structure built over the site. By way of the present soil transformation method, the organics 112 can be identified and removed when forming the conditioned soil 200, thus eliminating the risks of such materials present in unconditioned natural soil.

Figure 4:
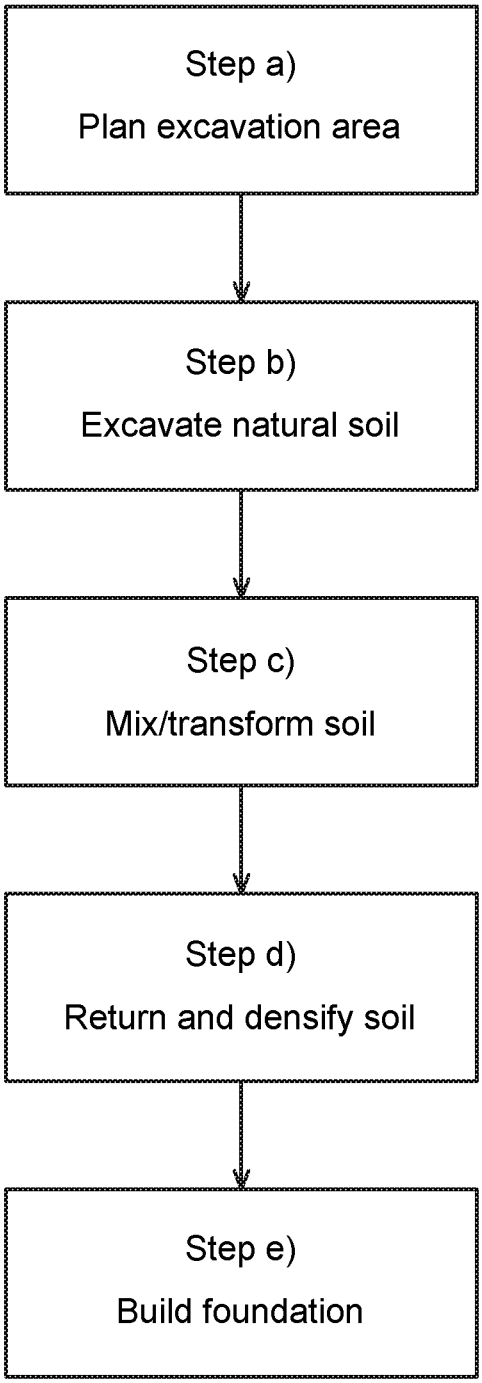
FIG. 4 is a flow chart illustrating steps in a soil transformation method according to an embodiment.

With reference to FIG. 4, a first step a) comprises planning an area to excavate. This step can comprise, for example, defining an area on a surface of the existing ground. The defined area can correspond to an area where the existing ground is to be transformed. In some embodiments, planning the area can also include determining a depth to transform the soil. It is appreciated defining the area may refer to demarcating, delimiting, outlining, etc. the surface of the ground so as to lay-out an outline of the ground to be transformed into a more stable foundation. Therefore, defining the area may include visually marking the ground, engraving ground, or performing any other similar action so as to fix the boundaries of the ground to be transformed. It may also include conceptually delimiting or mapping a defined area to transform, and may be done based on the required foundation specifications of a structure to be build thereon. The planned area and depth can determine where the natural soil will be transformed with conditioned soil, for example by excavating the natural soil from the area and subsequently returning the conditioned soil to the excavated area. The outlined area can correspond to an entire area of a foundation to be formed or only a section thereof.

Figure 5B:
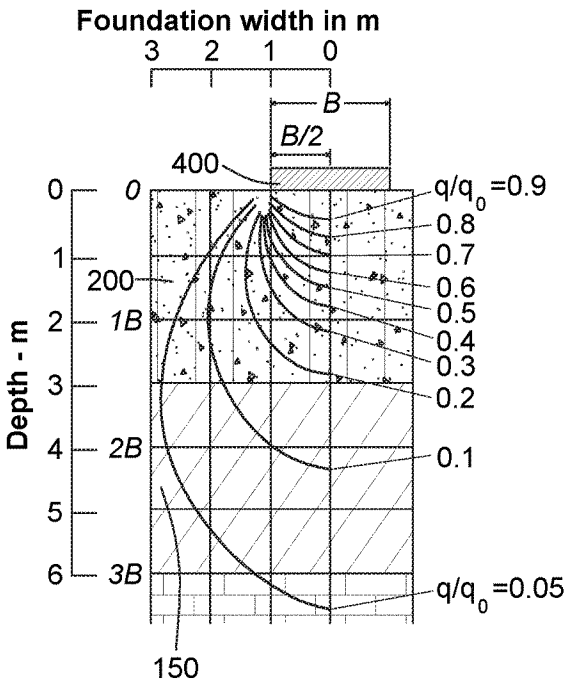
FIGS. 5A and 5B are schematics respectively illustrating the influence at depth of a foundation footing on natural loose soil and on soil transformed and densified according to the method of FIG. 4, and showing how a footing size can be reduced due to increased bearing capacity of ground transformed by the method of FIG. 4.
Figure 5A:
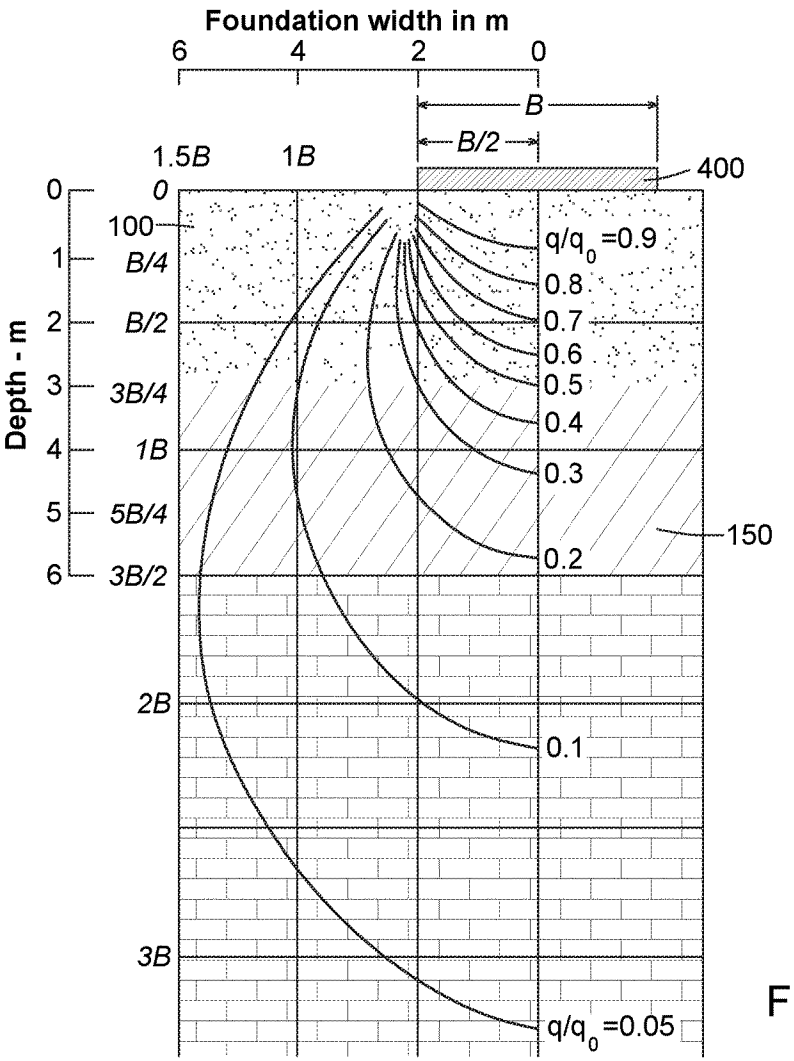

The area and depth of transformation can be chosen according to several factors. In order to properly support a structure, a foundation requires stable soil which extends over an adequate area and to an adequate depth. For example, a foundation footing will have an influence on the soil which extends laterally and to a depth. As illustrated in FIG. 5A, a foundation footing 400 will distribute stress $q_0$ to the soil in a bulb shape. The amount of stress "felt" by the soil at a given depth can be represented as q. As illustrated with the ratio $q/q_0$, the stress felt by the soil reduces as the bulb extends away from the footing.

In order for such a footing to properly support a structure, adequately stable soil is required in the area influenced by the bulb where the stress is significant, for example where $q/q_0$ is 0.2 or more. As can be appreciated, depending on the size of the foundation, significant stress can extend shallower or deeper into the soil. The planned area and depth should therefore be selected such that conditioned soil with adequate bearing capacity will be provided in these areas. In order to further assure stability in case of earthquakes, non-liquefiable soil should extend throughout the depth, generally to at least 20 m, and preferably to about 30 m or more. If the natural soil is liquefiable, the planned excavation area and depth should be selected such that non-liquefiable conditioned soil can be provided to a sufficient depth.

As illustrated in FIG. 5A, a footing 400 with width B (for example 4 m) resting atop ground 100 with poorly graded natural soil will transfer a significant amount of stress, i.e. $q/q_0$ between 0.2 and 1, to the loose soil in ground 100 (for example to a depth of 6 m or 1.5 B) and to a compressible soft clay formation 150 underneath, thereby exceeding the bearing capacity of the soil or its pre-consolidated measure, and increasing the settlement of the foundation. In contrast, when the soil is treated, as illustrated in FIG. 5B, the foundation width can be reduced (for example by half, to 2 m in this example) according to the new bearing capacity for the conditioned soil. In this configuration, the stress from the footing will be mainly dissipated (i.e. for $q/q_0>0.2$) in the dense, well-graded conditioned soil 200 (for example in a depth of 3 m corresponding to 1.5 B). If the soil 200 is conditioned at a sufficient depth, for example 1.5 B, the compressible soft clay layer 150 underneath will not experience significant amount of stress (i.e. $q/q_0=0.2$ and less), increasing the bearing capacity of the soil mass, reducing settlement, and making it more suitable for supporting heavy structures. As can be appreciated, in the illustrated example, the soil transformed and densified in FIG. 5B can allow for a bearing capacity two times greater, or more, than the unconditioned soil of FIG. 5A, and can thus also allow for the footing size to be correspondingly reduced by half.

Figure 6B:
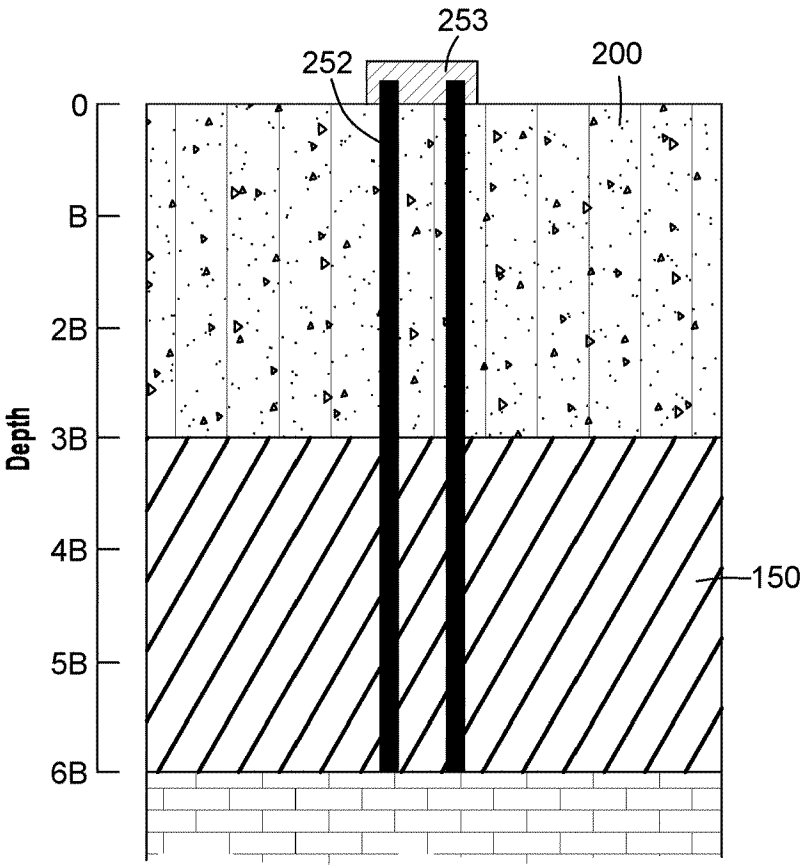
FIGS. 6A and 6B are schematics respectively illustrating the effect of an earthquake on piles extending through loose natural soil, and on piles extending through soil transformed according to the method of FIG. 4.
Figure 6A:
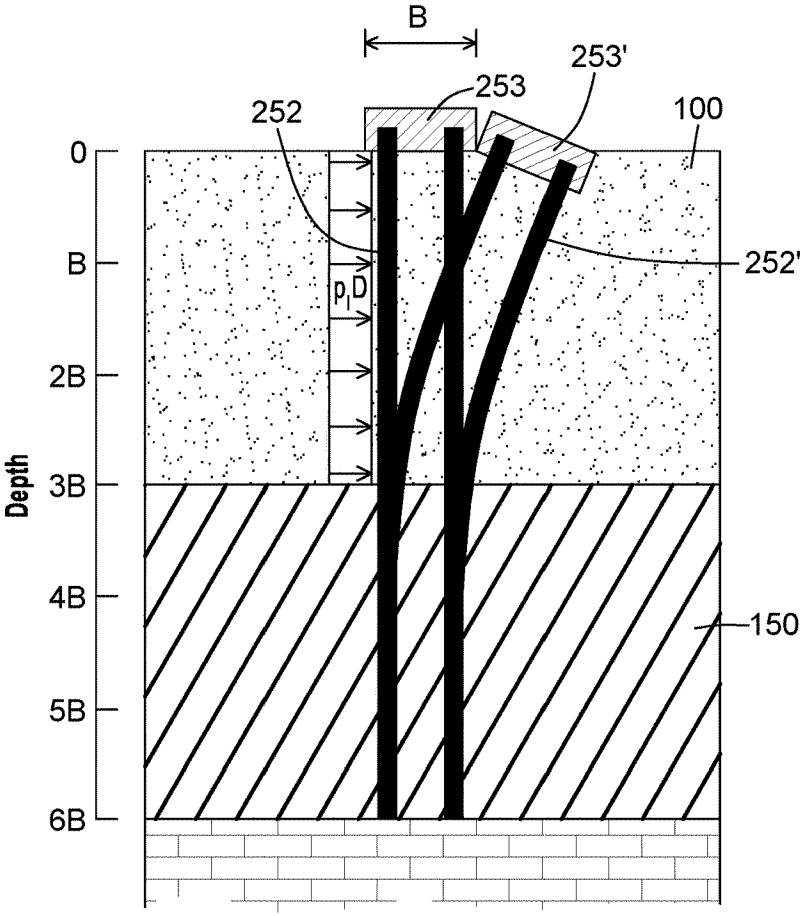

As can be appreciated, the soil transformation requirements can vary according to the type of foundation structure. For example, in some embodiments, as illustrated in FIG. 3A, the soil can be conditioned to a depth extending until bedrock 110 or a dense till. When the foundation structure comprises piles extending to the bedrock, as illustrated in FIGS. 6A and 6B, it is preferred that the soil surrounding the piles 252 be seismically stable to prevent damage to the piles during earthquakes. For example, as shown in FIG. 6A, a top section of piles 252 are surrounded by ground 100 with natural soil which comprises liquefiable loose to compact uniform granular soil, while a bottom section of piles 252 is surrounded by non-liquefiable compressible clay 150. In such a configuration, an earthquake can cause the soil in ground 100 to liquefy, displace and/or spread in a direction $p_rD$, causing the upper section of piles 252 and the pile cap 253 to displace and/or deform from an initial condition to a new condition 252', 253'. In contrast, as shown in FIG. 6B, with the soil in ground 100 transformed into conditioned soil 200, the upper section of piles 252 is surrounded by seismically stable dense to very dense well graded granular soil which is not liquefiable. The occurrence of possible soil liquefaction or significant pile deformation under earthquake forces is therefore greatly reduced. In such a scenario, it may therefore be desirable to choose an excavation depth which will condition all liquefiable layers so that the end-bearing piles are sufficiently stable. In the case of friction piles, the conditioned soil should extend to the bottom of the liquefiable soil thickness to insure the conservation of the soil friction and no lateral soil spreading during an earthquake.

Figure 7A:
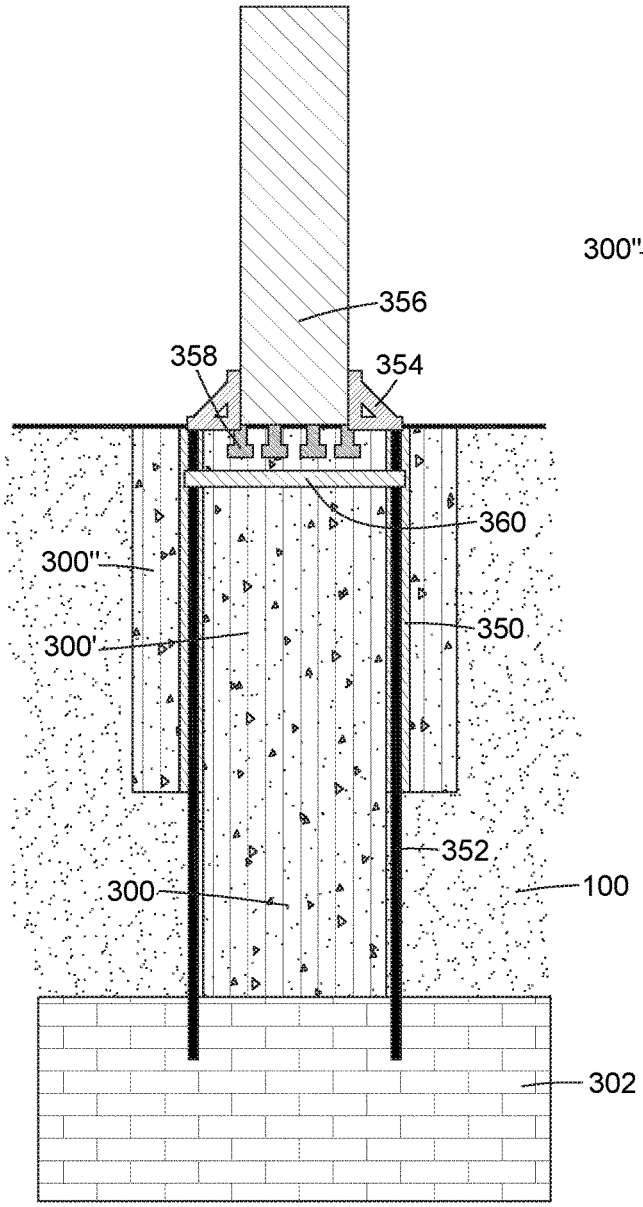
FIG. 7A is an elevation cross section of a foundation, according to an embodiment, comprising buried structures in a mass of soil conditioned according to the method of FIG. 4, and showing confining structures stabilizing a building during earthquakes.
Figure 7B:
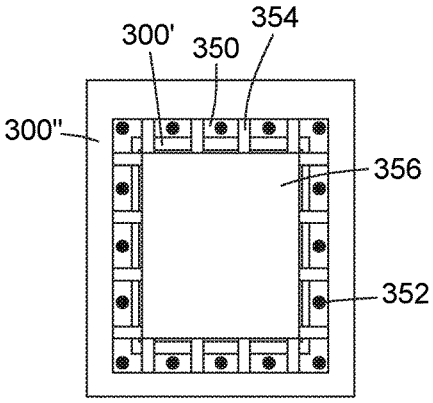
FIG. 7B is a plan view of the foundation of FIG. 7A.
Figure 7C:
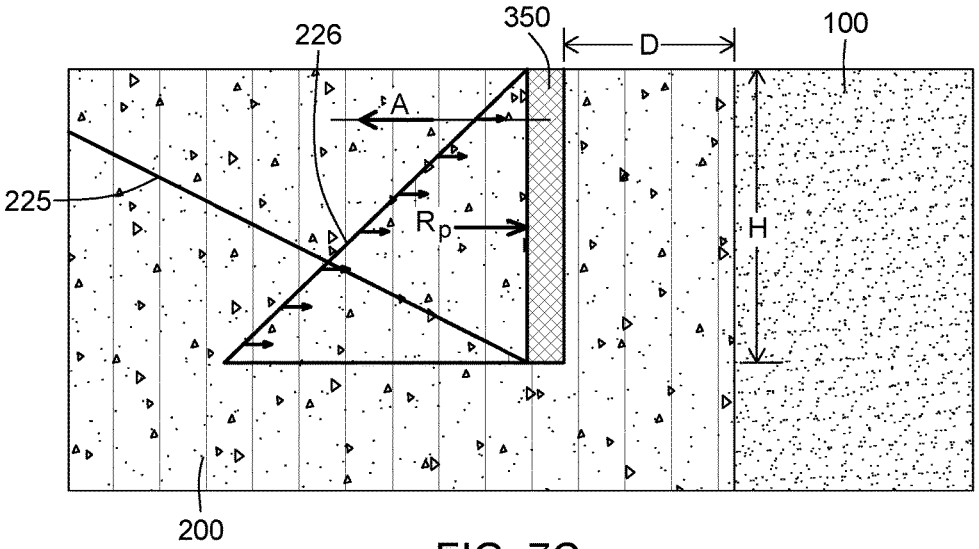
FIGS. 7C and 7D are schematics illustrating the passive resistance offered by the buried structures in FIGS. 7A and 7B against earthquake-induced forces.
Figure 7D:
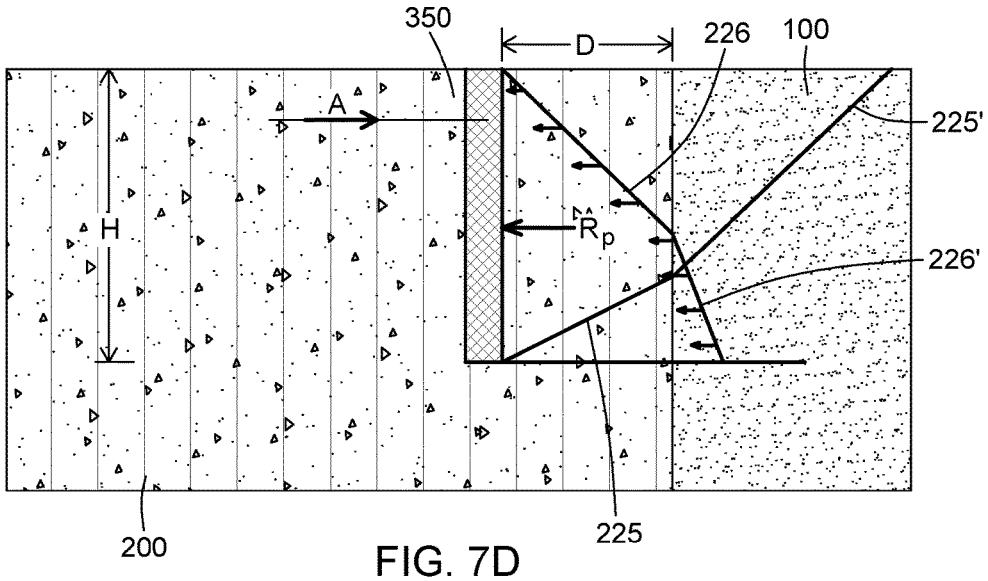

In the case of a buried foundation wall, such as those illustrated in FIGS. 7A, 7B, 7C and 7D, it is generally preferable to have conditioned soil 200 which extends a sufficient distance D on either side of the wall 350, usually by about at least 5 m. As shown in FIGS. 7C and 7D, a force A applied to one side of the wall is passively resisted $R_p$ by the volume of soil, and its shear strength parameters, above the rupture surface 225 (in the conditioned soil), 225' (in the unconditioned soil) on the opposite side of the wall. As can be appreciated, the rupture surface in the conditioned soil 225 has a shallower slope than that of the unconditioned soil 225', thus resulting in a larger volume of soil there-above resisting the force A, and resulting in a higher passive resistance $R_p$ as illustrated by the passive pressure diagram in transformed soil 226 vs. in untransformed soil 226'. It is therefore preferred to have sufficient conditioned soil 200 along either side of the wall, for example between at least 3 m to 5 m, to provide adequate resistance under any earthquake acceleration direction. The stronger the conditioned soil 200, the higher the passive resistance of the soil and its ability to confine with minimal deformation the structure foundations and buildings under earthquake loadings.

Other types of foundation structures are of course possible, and the area and depth for the conditioned soil can be chosen according to their particular requirements. Some foundations can employ several different types of foundation structures, for example with a combination of piles, anchors and buried structures as illustrated in FIG. 7A, and the locations of soil to be excavated/conditioned can vary according to the depth and lateral extent.

As can further be appreciated, in some embodiments, the planned area can be selected such that soil is only conditioned in areas adjacent to or surrounding foundation structures. For example, if a foundation comprises four spaced-apart footings, the soil can be transformed in areas influenced by the footings, while the natural soil between the footings can remain untouched. In alternate embodiments, the soil can be conditioned continuously over the entire area of a site, thus providing "un-liquefiable" soil on the whole site, making the foundation further resistant to earthquakes and is strongly recommended.

The area and depth can also be determined according to the desired particle composition of the conditioned soil. As can be appreciated, in order to have a well-graded soil, several different particle sizes may need to be mixed together in order to obtain a mixture of particles which adequately represents a full range of particle sizes. The chosen excavation area and depth will determine which layers in the natural soil will be extracted, and thus which layers will be available to be used in the conditioned soil mixture. In some cases, it may be required to excavate to a greater depth in order to retrieve soil with particular particle types and sizes. Preferably, the composition of the final mixture is selected such that it can achieve a service bearing capacity after compaction of 300 kPa, 450 kPa or much more.

Accordingly, planning the excavation area and depth may involve the substep of performing a preliminary soil study and measuring the particle composition of the soil layers. The composition of the soil layers can be measured using known methods, for example using gradation sieve analysis, cone penetration or a cone penetrometer test. This information can then be used to determine which types of particles need to be combined to obtain a well-graded mixture, and therefore which layers will need to be excavated for use in the mixture. It can also assist in planning a ratio of the different soil layers to be mixed together, and determine whether imported soil will be necessary to form well-graded soil with a sufficient volume. As can be appreciated, such measurements generally only provide estimates of the soil composition and the actual soil composition may be different due to geological variations throughout the site. The soil composition can thus be adjusted during excavation as the actual soil composition throughout the site becomes known.

Referring back to FIG. 4, a second step b) comprises excavating the natural soil according to the planned excavation area and depth. Preferably, the soil is excavated throughout the area outlined in step a), to a depth extending through the single or plurality of layers of different soil types, for example to at least 2 m and preferably to at least 20 m, 30 m or more. In the present context, excavating can refer to digging into the ground in the area outlined in step a). In some embodiments, excavating can include extracting and/or displacing soil from the outlined area to form a hole or a large trench, and/or removing soil to reveal the soil layers at depth. In some embodiments, excavation can comprise digging into the ground to dislodge or rearranging soil from its natural location. The excavation can be performed using any suitable digging tool such as a shovel, digger, scoop, trowel, dredge, etc. The digging tool can be operated mechanically, pneumatically, and/or hydraulically, for example by a device such as a backhoe, excavator, or the like. Preferably, the device can be used with interchangeable tools, allowing the device to be used to perform other tasks in subsequent steps of the method described herein. As can be appreciated, several devices or sets of devices can be used concurrently on the same site to expedite the excavation process. Moreover, the entire area need not need excavated at once, and can involve excavating a partial area of the site before moving on to another partial area.

During the planning step, it may have been determined that some layers in the natural soil are not desirable in the final soil mixture. For example, non-compactable or unstable material such as weak sensitive soft clay and sensitive clay silt and materials with low shear strength (i.e. with a low friction angle and low cohesion, resulting in a shear strength less than about 15 kPa) may serve to weaken the final soil mixture. Organic material, such as peat, may further serve to weaken the final soil mixture, as it is susceptible to degradation. Additionally, during the excavation process, objects not suitable for mixing may be uncovered such as large boulders, or foreign objects such as old cars. Essentially, any material which can potentially affect the short term or long term stability of the soil should not be included in the final soil mixture. Accordingly, the excavation and soil treatment processes can involve the substep of removing undesirable soils and/or undesirable objects from the extracted soil. This substep can involve separating the undesirable layers and/or objects from the desirable layers, for example by storing the two in separate piles, and/or by simply excluding the undesirable materials from the soil mixture. The undesirable layers and/or objects can further be transported to a remote site, or elsewhere on the current site, for disposal, recycling or repurposing.

Preferably, all the soil in the planned area and depth is excavated. Performing such an excavation gives full knowledge of the actual soil composition in the excavated area. As such, during the excavation process, the excavated soil can be further analyzed to determine the exact quantities of material available for the soil mixture. With this information, the planned excavation area and depth can be revised as necessary. For example, if during the excavation it is found that there are unstable layers, the excavation can be performed deeper than originally planned in order to remove such undesirable layers. Moreover, the soil additives and/or exclusions can be adjusted as well. For example, if upon excavating the soil it is determined that the natural soil layers lack or have a surplus of certain particle sizes needed to obtain a well-graded conditioned soil mixture, additives can be added and/or natural soil layers can be excluded in order to correct for the surplus or deficiency of the identified particles sizes.

As can be appreciated, excavating in this manner provides feedback, allowing the soil transformation process to be adjusted as necessary while it is executed, and allowing for the final properties of the soil to be known with more certainty. As a result, the risks of such a process are mitigated, as it is a "design as you go" method rather than "execute as planned", allowing the method to adapt to geological variations to obtain the desired result.

Referring back to FIG. 4, a third step c) involves mixing the soil excavated during step b). The soil can be mixed using any suitable method and using any suitable tools, such as excavation tools with proper handling of the material during mixing and stockpiling, for example. Preferably, the soil is mixed such that the resulting mixture is homogeneous. In some embodiments, a single soil type can be mixed so that it is homogeneous, or a plurality of different soil types can be mixed together. Preferably, when materials from a plurality of layers is mixed, the layers of natural soil are evenly distributed throughout the mixture. In some embodiments, the soil can be mixed after all the layers have been excavated. In other embodiments, the soil can be excavated layer-by-layer or in discrete depth intervals, and adjacent layers or discrete depths of soil can be mixed to form an intermediate mixture, before excavating a subsequent layer or discrete depth to mix with the intermediate mixture. This can be repeated until the full depth of the outlined area is excavated, and the intermediate mixture corresponds to a homogenous conditioned soil mixture comprising all the desired layers of different soil types.

In some embodiments, it may be desirable to introduce additives into the mixture to further improve the soil properties, for example to increase the mixed soil's bearing capacity, minimize compressibility and improve stability. Depending on the types of additives introduced into the soil mixture, unconfined compression strength of the conditioned soil may reach between 1 to 15 MPa. Accordingly, mixing the excavated soil can comprise the substep of introducing additives into the soil mixture, thereby producing a conditioned soil.

One type of additive can be foreign soil, for example soil which have been imported from a foreign site which can be remote of the current site where the ground is being transformed. During the planning and excavation steps, it may have been determined that the layers of natural soil lack or have a surplus of material with a particular particle type or size, and that the resulting soil mixture would be gap-graded (in other words, the resulting soil mixture would represent most particles sizes, but would be missing some specific particle sizes), or otherwise poorly graded. In such a scenario, it may not be possible to create a very well-graded soil mixture using only the natural soils available on site. As such, it may be desirable to add foreign soil to the mixture. The term foreign soil is used here to refer to any soil, natural or synthetic, not readily available during the excavation, and not naturally occurring on the site where the ground is being transformed. For example, if the excavated natural soil lacks fine particles, soil from a different and preferably nearby remote site (such as a borrow pit, for example) can be transported to the excavation site and added to the mixture in order to produce a well-graded soil mixture. Similarly, it may be determined during the planning and excavation steps that the final soil mixture will not have a sufficient volume after compaction to cover the excavated area. In such a scenario, fillers can be added to provide the final soil mixture with additional volume while maintaining the good grading of the final soil mixture. Fillers can include any suitable material which would not compromise the strength of the final mixture, and could include other well-graded soils for example.

Another type of additive can be admixtures or cementing agents. These types of additives can be introduced into the soil mixture in order to produce a treated soil with increased strength and reduced permeability. Many different types of known cementitious materials can be added to the mixture, including sodium silicate, silicasols, phenols, aminoplasts, microfine cement-based materials, polyesters, and the like. New admixtures that are continuously being developed can also be used in conjunction with the presently described process. Preferably, the type and quantity of admixture additives should be selected such that mixture sets, cures and/or solidifies within the appropriate delays. For example, conditioned soil can be treated with the admixtures such that takes between 3 and 4 days to set, thereby leaving sufficient time to complete the remaining steps in the process. Conditioning of the soil in this fashion can allow the soil to deliver service bearing capacities higher than 1000 to 2000 kPa after deep densification, along with lower compressibility, minimizing foundation settlement and yield a reduced soil permeability, turning the original soil into a quasi-sedimentary rock after its conditioning and densification and thus allowing the soil to approach the properties of a Class B site.

Referring back to FIG. 4, a fourth step d) can involve returning the conditioned soil to the excavated area and densifying the conditioned soil. Preferably, the conditioned soil is returned such that it fills the depth excavated in step b). The soil mixture, now well-graded, will have superior properties (i.e. homogeneous, more suitable for compaction and reduced deformation) than that of the original natural soil and can therefore be said to be transformed or conditioned. In an embodiment, the conditioned soil can be returned directly to the excavated area without additional manipulation. Mixing the soil and returning it to the excavated area in this fashion can assure that the resulting soil is homogeneous throughout the fill area. Existing soil compaction techniques such as dynamic compaction, vibroflotation, etc. can be applied to the conditioned soil in order to further improve soil conditions for forming a foundation. As can be appreciated, now that the soil has been transformed, techniques such as dynamic compaction, vibroflotation etc. can result in a compacted soil with superior properties than could otherwise be obtained if performed on untransformed, natural soil.

In an embodiment, instead of returning the soil mixture to the excavated area all at once, the soil can be returned in successive layers. For example, between approximately 0.5 m and 20 m, and preferably between about 1.5 m and about 3 m, of the mixed soil can be returned at a time, with each layer being compacted before depositing a subsequent layer. This process of layering and compacting can be repeated until the excavated area is completely filled.

As can be appreciated, compacting the soil in this fashion allows for the transformed soil to be densified throughout the entire depth of the excavated area. Moreover, the process can be controlled in each layer, assuring consistent densification in each layer, and further promoting homogeneity. As a result, the soil mass resulting from this method can have consistent properties throughout and can thus be more predictable. This is advantageous, because contractors and engineers would otherwise have to account for the possibility that the soil is different between boreholes where soil samples were taken. This means that they generally have to design for a bearing capacity safety factor of 3 or greater, whereas in the present case a safety factor of 2 or even 1.5 can be sufficient thanks to the reduction of risk levels.

Compacting the soil in each layer (or after the soil has been completely returned) can be performed using any suitable known compaction techniques including static, impact, vibrating, gyrating, rolling and kneading compaction, although a kneading compaction is generally preferred. A powerful kneading of the soil will cause the soil to fracture and liquefy, allowing for the admixtures to spread evenly and further increasing the homogeneity of the conditioned soil. The kneading action can further cause excess moisture to be expelled from the conditioned soil. As a result, the moisture content of the conditioned soil can be controlled layer by layer, allowing for a result which can achieve high densities and increased soil impermeability.

In an embodiment, the conditioned soil can be kneaded using vibratory plates which apply compression and shear to the soil by alternating movement in adjacent directions. The vibratory plates can be hydraulically or pneumatically driven, depending on the equipment and power supplies available on site, among other factors. In some possible configurations, the vibratory plate is connected to, and powered by, a hydraulic circuit, which can originate from equipment on site or be an independent circuit specific to the vibratory plate. Such a circuit advantageously may provide the requisite power and durability required to apply the vibrational force, from the bottom of the excavation depth all the way up to the surface.

Where the circuit originates from a device on site, the vibratory plate can be connected to such device. In one such configuration, the vibratory plate can be used with the same device which powered the digging tool used for excavating. The vibratory plate can thus be interchanged with the digging tool once the excavation operations have ceased. One example of how such interoperability might work includes the following: the digging tool is mounted to the device to excavate the various layers of natural soil. Once the layers are mixed and the soil is conditioned, the digging tool can be used to return a 0.5 m to 20 m and preferably 1.5 m to 3 m thick layer of conditioned soil back to the excavated area. The digging tool can then be replaced with the vibratory plate to compact the layer of conditioned soil. Finally, once the compaction is complete, the vibratory plate can be replaced with the digging tool, and the above-described steps can be repeated for subsequent layers of conditioned soil. This interchanging of the digging tool and the vibratory plate can advantageously allow for the overall process to be more efficient and more cost effective.

In another configuration, the compaction can be performed with a compaction device, which can form part of a larger system. The device may include a vibratory steel plate, measuring about 2.5 ft×2 ft, although plates of different sizes can also be used. The vibratory plate can be functionally attached to the arm of a hydraulic shovel, for example, which is generally readily available on construction sites. In this configuration, the vibratory plate can be lowered by the shovel's arm to compact at various depths. In another optional configuration, the vibratory plate can also be functionally attached to a crane and/or other similar device, and lowered accordingly into the excavated depths. This technique of compacting at depths allows for workers on site to readily intervene if necessary, such as if obstacles are found in close proximity to the compacted and/or excavated area, for example.

Figure 8:
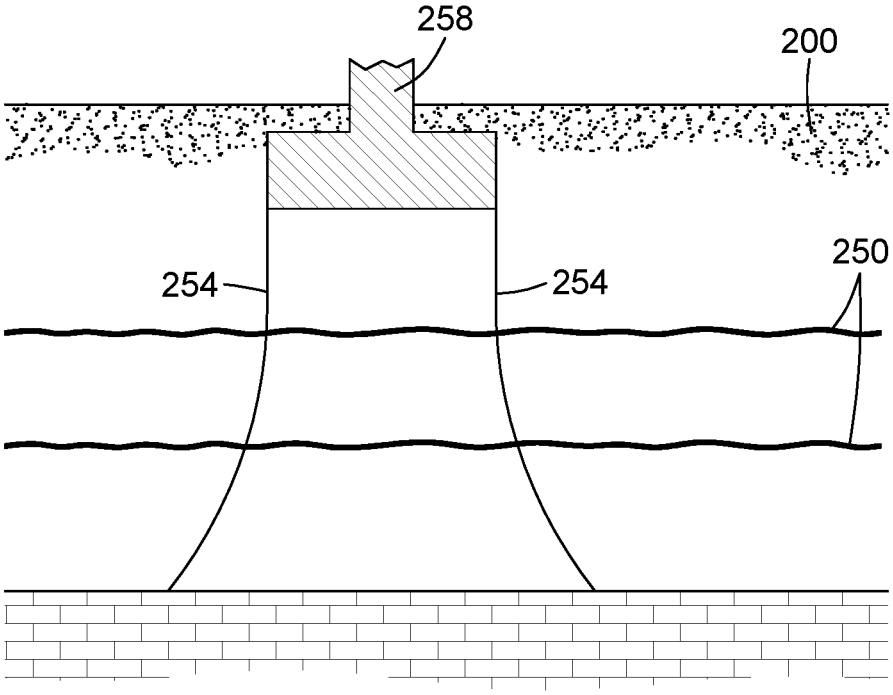
FIG. 8 is a schematic illustrating the effect of geogrids on the lateral spreading in soil of stresses induced by a foundation footing.

In some embodiments, it may be desirable to further reinforce the conditioned soil, for example under footing imprint areas, in order to minimize lateral stress transfer. This further reinforcement can be provided by means of superposed geogrids, metal strips, geotextile sheets or the like. With reference to FIGS. 5A and 5B, without geogrids or the like, stresses transferred from foundation footings to the soil tend to extend laterally and form a bulb-shape. In contrast, as illustrated in FIG. 8, provision of superposed geogrids 250, or the like, underneath a footing 258 can have a significant reduction effect on the lateral spreading of stress in the soil. As schematically illustrated by lines 254, with the provision of geogrids 250, stresses do not extend laterally as much, keeping them more confined as they extend through the depth of the soil. As can be appreciated, provision of such reinforcements allows foundation footings to be built closer to one another without fear of superposing significant stresses at depth. These reinforcement structures can be installed using the presently described method while the conditioned soil is being returned to the excavation area layer by layer. As can be appreciated, the high properties of the dense conditioned soil offer a good medium for the reinforcement efficiency and performance of these reinforcement structures.

Referring back to FIG. 4, once the conditioned soil has been returned to the excavated area, an additional final step e) can involve building a foundation structure. Any suitable foundation structure can be built on or in the conditioned soil. Moreover, the foundation structure can be for different types of buildings. For example, the soil transformation steps can be applied in the context of providing a stabilized foundation for sensitive structures such as dams or bridges. As described above, the steps a) through d) can result in the elimination of risks otherwise present in unconditioned soil, such as degradation or sinkhole development, making the transformed soil a more suitable foundation for such sensitive structures. Step e) can therefore involve the step of building a dam, bridge, or other such structure on the transformed soil.

As can be appreciated, once the soil has been conditioned using the method described above, it may be able to deliver bearing capacities of up to 600 kPa (and even up to 2000 kPa when admixtures are introduced into the conditioned soil), where the densification of the natural soil may not allow more than 150 kPa. This can allow for a size reduction of foundation footings and reduce their influence at depth. This is advantageous, for example, where very large concrete masses are needed to stabilize a structure under earthquake solicitations. Due to their size, such masses would have a great effect at depth. However, with soil conditioned with the present method, it is possible to reduce the contact area of such large masses and accommodate the resulting increase of soil stressing during earthquakes, thanks to the higher bearing capacity of the conditioned soil, as illustrated in FIGS. 5A and 5B.

Figure 9A:
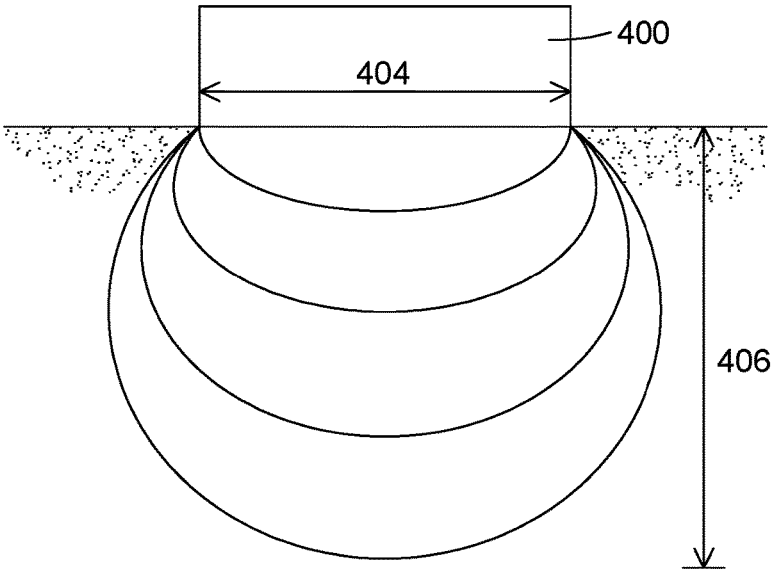
FIG. 9A is a schematic illustrating a foundation footing.
Figure 9B:
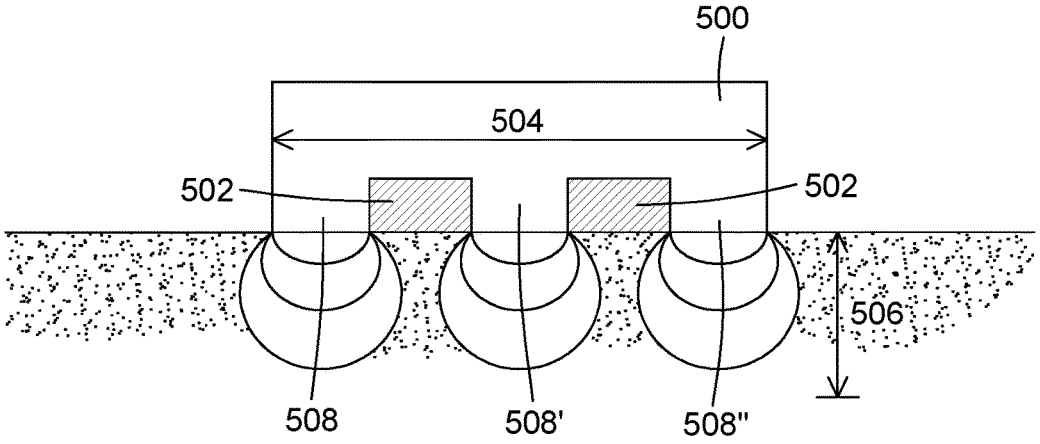
FIG. 9B is a schematic showing a foundation footing influence at depth from a reduced contact area with the conditioned soil.

One way to reduce the contact area of foundation footings is shown in FIGS. 9A and 9B. As illustrated in FIG. 9A, a foundation footing 400 is shown. The foundation footing 400 can be made of concrete for example, and distributes stress to the ground along its full width 404, thus causing a stress bulb which extends to a significant depth 406. As shown in FIG. 9B, a modified foundation footing 500 is provided. The modified foundation footing 500 can have its contact area reduced by segmenting the contact area with the provision of highly compressible styrofoam blocks or strips 502, or the like. As can be appreciated, stress will be dissipated mostly through the concrete portions 508, 508', 508" in contact with the ground, and not through the Styrofoam areas.

In the illustrated embodiment, the contact area of the footing 400 is reduced to three smaller segments 508, 508', 508", which are each smaller than the width 504 of the footing. As a result, the stress bulbs of each segment 508, 508', 508" extend to a lesser depth 506, than they otherwise would in the footing 400 of FIG. 9A. As can be appreciated, due to the increase of pressure caused by the reduced footing size, more stress will be dissipated in the upper layers of soil.

However, the conditioned soil created using the method described above should have sufficient bearing capacity to withstand the increased stress.

As can be further appreciated, in the modified footing 500, stress is dissipated in three distinct stress bulbs instead of the one stress bulb of 400. The provision of geogrids or the like in the conditioned soil can further prevent these stress bulbs from superposing and creating significant stresses at depth.

As can be appreciated, the conditioned soil created with the above-described method will further be stable under earthquake liquefaction, have reduced permeability properties, and will not be sensitive to either liquefaction settlement or lateral spreading, thus forming a highly stable ground for construction purposes and conforming to building codes. Such properties further offer a sound reserve for unforeseen earthquake magnitudes. In general, when conducting liquefaction analysis based on soil properties and expected levels of earthquake magnitude and acceleration, a safety factor between 1 and 1.2 is selected depending on the risk sensitivity of the proposed structure. In other words, the foundation is designed such that it can withstand liquefaction from expected earthquake magnitudes or from earthquake magnitudes which exceed expected magnitudes by 20%. When designing for a safety factor, engineers and contractors are often limited by soil properties and do not have sufficient reserve for earthquake strengths which exceed those which were considered during the design of a structure. Using the method described above, however, the conditioned soil is, in principle, no longer liquefiable, allowing it to more readily withstand the effects of earthquakes (and even for larger earthquakes than known for the site region) and reduces the risk associated with underestimating the safety factor in case of a more severe earthquake.

In addition to forming a stable mass against liquefaction and a strong foundation soil for high-rise buildings, the soil conditioned using the present method offers the option for restraining continuous or local buried structures at the perimeter of buildings to fully prevent its translation and its rotation at the foundation level during earthquakes. This statement applies in all directions of earthquake forces and moment.

In an embodiment, these reinforced concrete structures can comprise "Garzon Walls" (as described in U.S. Pat. No. 8,898,996, the content of which is incorporated herein by reference). These structures can be installed in a designed volume of conditioned soil that will minimize wall displacement upon the loadings transferred to it by the building, during an earthquake for example, thus preventing rotation and sliding, and insuring the building stability by counteracting rotation and sliding forces.

With reference to FIGS. 7A and 7B, reinforced Garzon Walls 350 can be installed in a volume of conditioned soil 300, 300' and positioned around a perimeter of a building imprint 356. In the illustrated embodiment, four walls 350 are installed along all four sides of the building imprint 356. It should be understood that in alternate embodiments the walls 350 need only be installed on some sides and still effectively support the building against translation and rotation. In some embodiments, the walls 350 need not extended the full length of the side of the building imprint 356, and portions of walls can be sufficient to effectively support the building. The building can be further stabilized against rotation with structural confinements 354 which anchor the building to the retaining walls.

The Garzon Walls 350 can be stabilized at depth with deep grouted piles 352, or the like, which can extend down to earthquake-stable natural soils 302, or bedrock. The piles 352 can be provided at regular intervals along the length of the Garzon Walls 350, and can further serve to treat the natural soil below the Garzon Wall. The Garzon Walls 350 can be provided with a stabilizing member 360, which allows the walls to work together for improved strength. As can be appreciated, conditioned soil 300 is provided along the fill height of the piles 352 so that they can avoid damage due to liquefaction during earthquakes. As can be further appreciated, the building foundations 358 extend into conditioned soil 300 which has a high bearing capacity and is able to support the significant pressure imposed by the foundations 358.

In the present embodiment, the walls 350 are confined by conditioned soil inside the walls 300' and conditioned soil outside the walls 300". The conditioned and densified soil on both sides of the walls 350 provide a high passive resistance associated with the improved soil properties, including its angle of friction and its high density, as illustrated in FIGS. 7C and 7D. The depth H of the wall 350 can vary according to the resistance required for a particular building, and can be chosen based on the anticipated earthquake solicitation on the structure and on the conditioned and densified ground properties. With conditioned soil 300 being provided along either side of the walls as illustrated, the increased passive resistance can allow for walls 350 to be constructed at a shallower depth than if the walls 350 were built in unconditioned soil.

As can be appreciated, soil conditioned using the present method has a number of advantages. Structurally, it can provide strong and stable soil which can be used as foundations for supporting large and/or sensitive structures, and can be used to enhance the strength and stability of many known types of foundation structures. The method described herein provides for an efficient way to create stable soil, using natural materials which are readily available on site, and without requiring many different types of equipment. As a result, the method can be more cost effective and less time consuming than other known methods for transforming or replacing soil. Moreover, the risk factors are considerably reduced using the present method; there are fewer uncertainties as the properties of conditioned soil can be known throughout the full depth of the excavated area, and the method can be adjusted and revised as necessary while being executed.

The invention claimed is:

1. A method of transforming existing ground of a given site having soil with a plurality of layers of different soil types into a more stable foundation ground, the method comprising the steps of:

a) defining an outlined area about a surface of the given site, the outlined area corresponding to an area of the existing ground to be transformed;

b) excavating the soil throughout the outlined area to a depth extending through the plurality of layers of different soil types;

c) conditioning the soil excavated in step b) by mixing together at least two of the plurality of layers of different soil types, thereby forming conditioned soil comprising a homogeneous mixture of the at least two of the plurality of layers of different soil types, and adjusting a composition of the homogeneous soil mixture such that the homogeneous soil mixture is substantially well-graded with a uniformity coefficient $C_u$ greater than about 4 and a coefficient of curvature $C_c$ between about 1 and about 3, where $$C_U = \frac{D_{60}}{D_{10}} \text{ and } C_C = \frac{D_{30}^2}{D_{10} \cdot D_{60}}$$

and where $D_{60}$ is a grain diameter of the homogenous soil mixture at 60% passing, $D_{30}$ is a grain diameter of the homogenous soil mixture at 30% passing, and $D_{10}$ is a grain diameter of the homogenous mixture at 10% passing;

d) returning the conditioned soil to the outlined area to homogeneously fill the depth excavated in step b) throughout the outlined area; and e) compacting the conditioned soil returned to the outlined area, thereby forming the stable foundation ground.

2. The method according to claim 1, wherein step e) comprises applying a vibratory force to the conditioned soil.

3. The method according to claim 1, wherein step e) comprises at least one of kneading the conditioned soil using a vibratory plate, densifying the conditioned soil using dynamic compaction, densifying the conditioned soil using vibroflotation, densifying the conditioned soil using stone columns, and densifying the conditioned soil using cemented columns.

4. The method according to claim 1, wherein steps d) and e) comprise returning the conditioned soil to the outlined area in successive layers, and individually compacting each successive layer prior to returning a subsequent layer of conditioned soil.

5. The method according to claim 4, wherein step d) comprises returning the conditioned soil to the outlined area in successive layers having a depth between about 0.5 m and about 20 m.

6. The method according to claim 4, wherein step d) comprises returning the conditioned soil to the outlined area in successive layers having a depth between about 1.5 m and about 3 m.

7. The method according to claim 1, wherein step b) comprises excavating the soil in the outlined area to a depth extending down to natural bedrock or to a dense till.

8. The method according to claim 1, wherein in step b), the soil in the outlined area is excavated to a depth of at least 2 m.

9. The method according to claim 1, wherein the composition of the homogenous soil mixture is adjusted to comprise a representation of all particle sizes falling within a range between about 0.001 mm and about 150 mm.

10. The method according to claim 1, wherein the composition of the homogenous soil mixture is adjusted to comprise a representation of every particle size between No. 4 to No. 200 sieves.

11. The method according to claim 1, wherein adjusting the composition of the homogeneous soil mixture comprises excluding from the homogeneous soil mixture at least part of at least one of the plurality of layers of different soil types excavated in step b).

12. The method according to claim 11, wherein adjusting the composition of the homogeneous soil mixture comprises completely excluding from the homogeneous soil mixture at least one of the plurality of layers of different soil types excavated in step b).

13. The method according to claim 11, wherein adjusting the composition of the homogeneous soil mixture comprises excluding from the homogeneous soil mixture at least one of the plurality of layers of different soil types comprising at least one of: organic material, non-compactable material, soft clay, clay silt and material with a shear strength of less than about 15 kPa.

14. The method according to claim 1, wherein adjusting the composition of the homogeneous soil mixture comprises selecting a mixing ratio for each of the plurality of layers of different soil types excavated in step b) required to obtain a well-graded soil mixture, and mixing the plurality of layers of different soil types together according to the selected ratio.

15. The method according to claim 1, wherein adjusting the composition of the homogenous soil mixture comprises identifying at least one of the plurality of layers of different soil types as being poorly graded by having an excess or deficiency of at least one particle size, and mixing the at least one identified layer with at least one other of the plurality of layers of different soil types to correct for the excess or deficiency of the at least one particle size.

16. The method according to claim 1, wherein adjusting the composition of the homogeneous soil mixture comprises mixing additives together with the at least two of the plurality of layers of different soil types.

17. The method according to claim 16, wherein adjusting the composition of the homogeneous soil mixture comprises identifying a deficiency of at least one particle size in the homogenous soil mixture, and mixing an additive comprising the at least one particle size together with the homogenous soil mixture to correct for the deficiency.

18. The method according to claim 16, wherein mixing additives together with the at least two of the plurality of layers of different soil types comprises mixing-in an additive comprising imported soil from a foreign site.

19. The method according to claim 16, wherein mixing additives together with the at least two of the plurality of layers of different soil types comprises mixing-in an additive comprising a filler comprising well-graded soil.

20. The method according to claim 16, wherein mixing additives together with the at least two of the plurality of layers of different soil types comprises mixing-in a cementing agent.

21. The method according to claim 1, further comprising individually analyzing a composition of the plurality of layers of different soil types as the plurality of layers of different soil types are excavated, and determining an amount of the analyzed soil layer to include or exclude from the homogeneous mixture to make the conditioned soil well-graded.

22. The method according to claim 1, further comprising individually analyzing a composition of the plurality of layers of different soil types as the plurality of layers of different soil types are excavated, and determining additives to include in the homogeneous mixture to make the conditioned soil well-graded.

23. The method according to claim 1, wherein step b) comprises completely excavating to the depth throughout the outlined area before proceeding to return the conditioned soil in step d).

24. The method according to claim 1, wherein step b) comprises excavating to the depth in a partial area of the outlined area, and returning the conditioned soil to the partial area in step d) before repeating step b) for another partial area of the outlined area.

25. The method according to claim 1, wherein steps b) and c) comprise excavating and mixing adjacent layers of different soil types to form an intermediate mixture, before excavating a subsequent layer and adding the subsequent layer to the intermediate mixture, and repeating until all the soil layers have been excavated to the depth.

26. The method according to claim 1, wherein step b) comprises extracting the excavated soil from the outlined area.

27. The method according to claim 1, wherein step b) comprises displacing the excavated soil away from the outlined area.

28. The method according to claim 1, wherein in step b), the soil in the outlined area is excavated to a depth of at least 20 m.

29. The method according to claim 1, further comprising building at least one of the following buried structures in the conditioned soil: piles, retaining walls, and anchors.

30. The method according to claim 1, further comprising positioning a foundation footing in direct contact with the conditioned soil, said foundation footing comprising a body having a ground-contacting area, the body being provided with one or more strips of compressible material to segment the ground-contacting area into sections.

31. A method of transforming existing ground of a given site having soil with a plurality of layers of different soil types into a more stable foundation ground, the method comprising the steps of:

a) defining an outlined area about a surface of the given site, the outlined area corresponding to an area of the existing ground to be transformed;

b) excavating the soil throughout the outlined area to a depth extending through the plurality of layers of different soil types;

c) conditioning the soil excavated in step b) by mixing together at least two of the plurality of layers of different soil types, thereby forming conditioned soil comprising a homogeneous mixture of the at least two of the plurality of layers of different soil types, and adjusting a composition of the homogeneous soil mixture such that the homogeneous soil mixture is substantially well-graded by mixing additives together with the at least two of the plurality of layers of different soil types, wherein mixing additives comprises identifying a deficiency of at least one particle size in the homogenous soil mixture, and mixing an additive comprising the at least one particle size together with the homogenous soil mixture to correct for the deficiency;

d) returning the conditioned soil to the outlined area to homogeneously fill the depth excavated in step b) throughout the outlined area; and e) compacting the conditioned soil returned to the outlined area, thereby forming the stable foundation ground.

32. A method of transforming existing ground of a given site having soil with a plurality of layers of different soil types into a more stable foundation ground, the method comprising the steps of:

a) defining an outlined area about a surface of the given site, the outlined area corresponding to an area of the existing ground to be transformed;

b) excavating the soil throughout the outlined area to a depth extending through the plurality of layers of different soil types;

c) conditioning the soil excavated in step b) by mixing together at least two of the plurality of layers of different soil types, thereby forming conditioned soil comprising a homogeneous mixture of the at least two of the plurality of layers of different soil types, and adjusting a composition of the homogeneous soil mixture such that the homogeneous soil mixture is substantially well-graded by mixing additives together with the at least two of the plurality of layers of different soil types, wherein mixing additives comprises mixing-in an additive comprising a filler comprising well-graded soil;

d) returning the conditioned soil to the outlined area to homogeneously fill the depth excavated in step b) throughout the outlined area; and e) compacting the conditioned soil returned to the outlined area, thereby forming the stable foundation ground.

* * * * *